US005915617A

United States Patent [19]

Gasper

[11] Patent Number: 5,915,617

[45] Date of Patent: Jun. 29, 1999

[54] AUTOMATICALLY-OPERATING BOTTOM STRUCTURE IN A COLLAPSIBLE CONTAINER

[75] Inventor: Thomas M. Gasper, Strongsville, Ohio

[73] Assignee: Creative Tech Marketing, Strongsville, Ohio

[21] Appl. No.: 08/872,367

[22] Filed: Jun. 10, 1997

Related U.S. Application Data

[63] Continuation-in-part of application No. 08/748,466, Nov. 8, 1996, Pat. No. 5,715,991, which is a continuation of application No. 08/621,042, Mar. 22, 1996, Pat. No. 5,613,694, which is a continuation of application No. 08/420,355, Apr. 11, 1995, Pat. No. 5,531,374, which is a continuation-in-part of application No. 08/344,989, Nov. 25, 1994, abandoned.

[51] Int. Cl.[6] ..... B65D 5/36

[52] U.S. Cl. ..... 229/109; 229/117; 229/184; 229/185

[58] Field of Search ..... 229/108, 108.1, 229/184, 185, 109, 117, 117.01

[56] References Cited

U.S. PATENT DOCUMENTS

| | | | |
|---|---|---|---|
| 1,720,146 | 7/1929 | Reese | 229/108.1 |
| 2,826,350 | 3/1958 | Marx | 229/117 |
| 2,858,968 | 11/1958 | Pellaton | 229/117 |
| 2,934,254 | 4/1960 | Ullger | 229/108.1 |
| 3,083,889 | 4/1963 | Christensson . | |
| 3,101,167 | 8/1963 | Styler . | |
| 3,115,291 | 12/1963 | Kotowick | 229/117.01 |
| 3,132,791 | 5/1964 | Haysler et al. . | |
| 3,344,971 | 10/1967 | Walker et al. . | |
| 3,373,917 | 3/1968 | Cox . | |
| 3,525,466 | 8/1970 | Robinson | 229/117 |
| 3,561,667 | 2/1971 | Saltman . | |
| 3,565,235 | 2/1971 | Brown . | |
| 3,642,192 | 2/1972 | Wilcox, Jr. et al. . | |
| 3,809,310 | 5/1974 | Vanderlught, Jr. . | |
| 3,877,631 | 4/1975 | Lai et al. . | |
| 4,109,985 | 8/1978 | Lieb, Jr. | 312/262 |
| 4,146,169 | 3/1979 | Meyers et al. | 229/117 |
| 4,166,567 | 9/1979 | Beach, Jr. et al. . | |
| 4,185,764 | 1/1980 | Cote . | |

(List continued on next page.)

FOREIGN PATENT DOCUMENTS

| | | | |
|---|---|---|---|
| 1439183 | 4/1965 | France . | |
| 2574755 | 6/1986 | France . | |
| PCT/US96/03802 | 3/1996 | WIPO | B65D 5/36 |

OTHER PUBLICATIONS

PCT Search Report as complied by European Patent Office (Applicant: Creative Tech Marketing, et al; International Application No.: PCT/US96/03803; International Filing Date: Mar. 22, 1996), prior art documents as cited therein.

PCT International Search Report as compiled by European Patent Office, International Application No. PCT/US98/10783, International Filing Date: Jun. 9, 1998, 3 out of 5 prior art documents cited therein.

Powder/Bulk Solids, *Product News,* Apr. 1998, p. 90.

Model Reproduction of Quickset "Bulk Box" from Inland Paperboard and Packaging.

*Primary Examiner*—Gary E. Elkins

*Attorney, Agent, or Firm*—Benesch, Friedlander, Coplan & Aronoff LLP

[57] ABSTRACT

An automatically-operating bottom structure for use in a collapsible container includes a band (1080, 1084; 2080, 2084) pivotally connected to a first pair of panels (1016, 1020; 2016, 2020), a first pair of bottom flaps (1120, 1122 and 1160, 1162; 2120, 2122 and 2160, 2162) connected to a second pair of panels (1018, 1022; 2018, 2022), a second pair of bottom flaps (1124, 1126; 2124, 2126) connected to a third pair of panels (1017, 1019; 2017, 2019), a third pair of bottom flaps (1164, 1166; 2164, 2166) connected to a fourth pair of panels (1021, 1023; 2021, 2023) a first pair of web panels (1128, 1130; 2128, 2130) and a second pair of web panels (1168,1170; 2168, 2170). The band and bottom flaps are folded within the container when the container is in a folded-flat condition, but automatically form an operative bottom structure when the folded-flat container is moved to a fully expanded condition.

19 Claims, 10 Drawing Sheets

U.S. PATENT DOCUMENTS

| | | | |
|---|---|---|---|
| 4,199,098 | 4/1980 | Lopez . | |
| 4,243,171 | 1/1981 | Prin . | |
| 4,244,510 | 1/1981 | Snyder et al. . | |
| 4,260,100 | 4/1981 | Hoffman . | |
| 4,289,267 | 9/1981 | Mayea . | |
| 4,448,309 | 5/1984 | Roccaforte et al. | 206/525 |
| 4,453,665 | 6/1984 | Roccaforte et al. . | |
| 4,470,540 | 9/1984 | Koltz . | |
| 4,549,690 | 10/1985 | Rosenburg . | |
| 4,607,785 | 8/1986 | Croley | 229/109 |
| 4,676,429 | 6/1987 | Crowe et al. | 229/109 |
| 4,742,915 | 5/1988 | Ringer | 229/109 |
| 4,747,485 | 5/1988 | Chaussadas | 206/427 |
| 4,760,922 | 8/1988 | Northgrave | 229/117.01 |
| 4,834,255 | 5/1989 | Boots | 229/109 |
| 4,854,474 | 8/1989 | Murray et al. . | |
| 4,856,705 | 8/1989 | Carr et al. | 229/109 |
| 4,871,068 | 10/1989 | Dreyfus | 206/428 |
| 4,881,683 | 11/1989 | Linnemann | 229/117.01 |
| 4,917,289 | 4/1990 | Linnemann et al. | 229/109 |
| 5,040,721 | 8/1991 | Essack | 229/112 |
| 5,115,965 | 5/1992 | Alepuz | 229/109 |
| 5,295,623 | 3/1994 | Bacques et al. | 229/109 |
| 5,531,374 | 7/1996 | Gasper | 229/109 |
| 5,613,694 | 3/1997 | Gasper | 229/109 |
| 5,630,543 | 5/1997 | Dugan | 229/109 |
| 5,715,991 | 2/1998 | Gasper | 229/109 |

AUTOMATICALLY-OPERATING BOTTOM STRUCTURE IN A COLLAPSIBLE CONTAINER

CROSS-REFERENCE TO RELATED APPLICATIONS

This is a continuation-in-part Ser. No. 08/748,466 filed on Nov. 8, 1996 (now U.S. Pat. No. 5,715,991) which is a continuation of Ser. No. 08/621,042 filed on Mar. 22, 1996 (now U.S. Pat. No. 5,613,694), which is a continuation of Ser. No. 08/420,355 filed on Apr. 11, 1995 (now U.S. Pat. No. 5,531,374) which is a continuation-in-part of Ser. No. 08/344,989 filed Nov. 24, 1994 (now abandoned).

BACKGROUND OF THE INVENTION

This invention pertains to the art of collapsible containers and more particularly to automatically-operating bottom structures for use with collapsible containers. The invention is specifically applicable to eight-sided collapsible containers of the type used in the meat packing industry and will be described with particular reference thereto. In an alternative embodiment, the invention combines an automatically-operating bottom structure with a collapsible container having a plastic liner affixed to the interior panel surfaces thereof. As the bottom structure is automatically-operated, the plastic liner is drawn into the container as it opens. It will be appreciated, though, that the invention has broader applications such as for use with multi-sided collapsible containers for products in other industries or for merchandising, store displays or the like.

One prior art automatically-operated bottom structure is disclosed in U.S. Pat. No. 4,856,705 to Carr, et al. That patent describes a box which may be unfolded in a simple manner from a closed to a fully-expanded condition by an operator inserting his hands into the top portion and extending the folded blanks apart to form the fully-expanded condition. As that occurs, a band flap spans a traverse distance between opposing panels. Bottom flap panels are then manually folded downwardly and interdigitally fitted with one another. The band flap prevents the bottom flap panels from pivoting more than 90° relative to their respective vertical side panels.

One problem with the above discussed automatically-operated box and many others like it is that an operator must bend over and insert his hands into the box to push apart the pair of vertical side panels. In addition, once the box is opened, the operator must then reach down into the box to interdigitally connect the bottom flap panels with one another. This procedure is inherently awkward, especially for large boxes, labor intensive, and time consuming.

In certain applications it is desirable that a box be opened by an operator by merely applying pressure to the outside surfaces of a pair of opposing panels forming the box. One such application is the meat packing industry where reaching into a fresh box to operate it into a fully-expanded condition may cause contamination thereof.

SUMMARY OF THE INVENTION

The present invention contemplates a new and improved automatically-operating bottom structure for use with a collapsible container adapted to be selectively moved between a folded-flat condition and a fully-expanded condition merely through application of opposing forces to outside surfaces of the container panels.

The automatically-operating bottom structure of the invention comprises a band pivotally connected to each of a first pair of panels forming a collapsible container. The band includes two sections pivotally connected to one another about an intermediate pivotal axis substantially parallel to the pivotal axes between said band and the first pair of panels. The two sections are arranged with respect to one another at an included angle of about 0° when the container is in a folded-flat condition and arranged with respect to one another at an included angle of about 180° when the container is in a fully-expanded condition. A first bottom flap is connected to a first one of the plurality of collapsible container side panels. The first bottom flap engages a first surface of the band and forms an included angle of about 90° with respect to the first panel when the container is in the fully-expanded condition. A second bottom flap is connected to a second one of the plurality of panels and engages a second surface opposite the first surface of said band and forms an included angle of about 90° with respect to the second panel when the container is in the fully-expanded condition. Lastly, a web panel connects the first bottom flap with the second bottom flap. The web panel moves in response to movement of the first bottom flap. Similarly, the second bottom flap moves in response to motion in the web panel. Thereby, motion of the first flap causes motion in the second flap.

Accordingly, it is a general object of the present invention to provide an improved automatically-operating bottom structure for use with an octagonal collapsible container.

Another object of the present invention is to provide a plastic or thin paper lining in an octagonal container, the liner which automatically unfurls with the automatic operation of the bottom structure.

These and other objects and advantages of the present invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
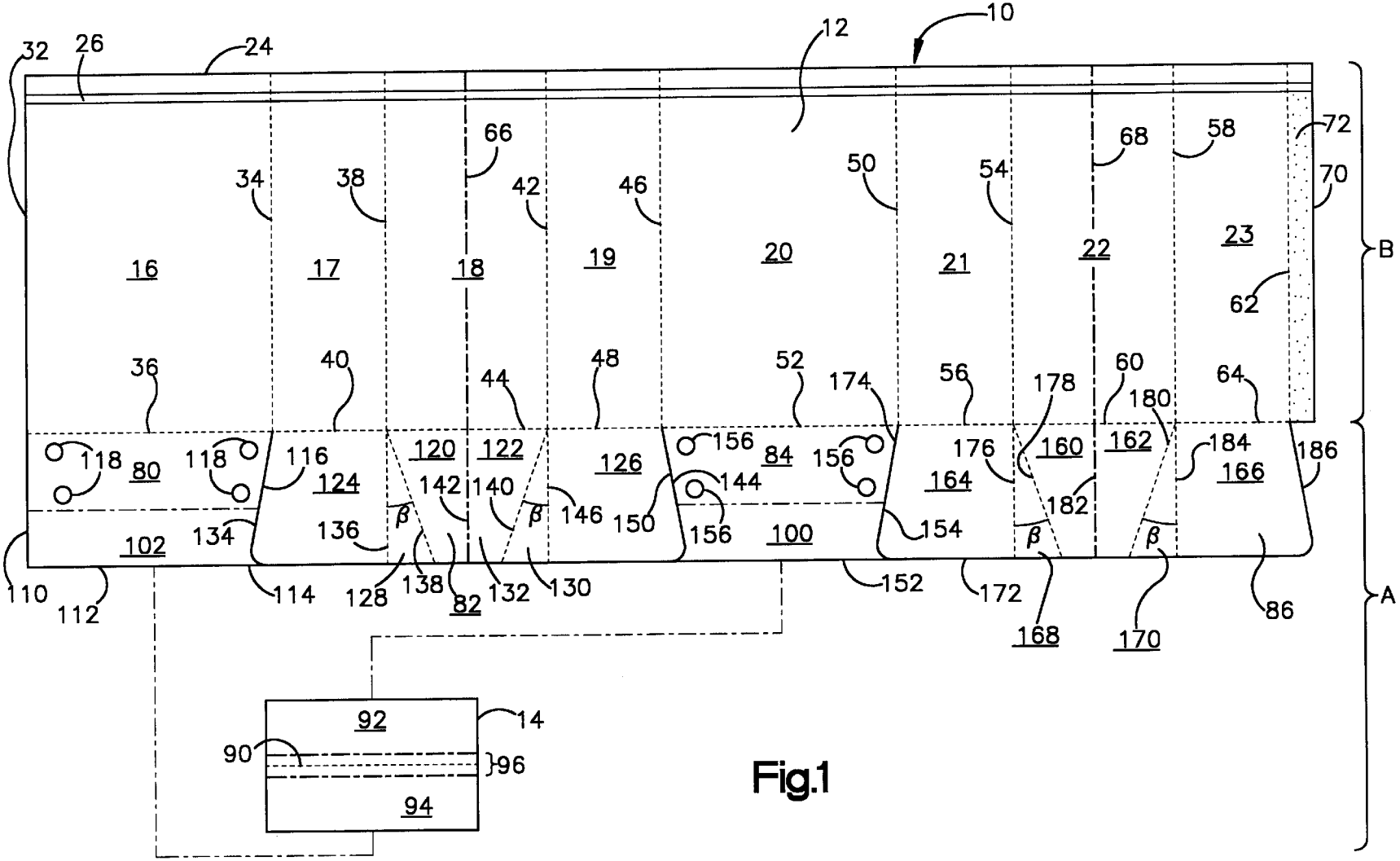
FIG. 1 is a plan view illustrating the preferred two-piece blank from which the self-opening collapsible container according to the present invention is constructed.

Referring now to the drawings wherein the showings are for purposes of illustrating the preferred embodiments of the invention only and not for purposes of limiting same, the figures show an improved automatically-operating bottom structure A for use with collapsible containers. Preferably, the invention is best used with a eight-sided collapsible container B and will be described with particular reference thereto. In an alternative embodiment, the invention includes the above-mentioned automatically-operating bottom structure in combination with a plastic liner affixed to the interior panel surfaces of an octagonal container. The linear unfurls as the automatically-operating bottom structure A is operated between a folded-flat condition and a fully-expanded condition.

Figure 2:
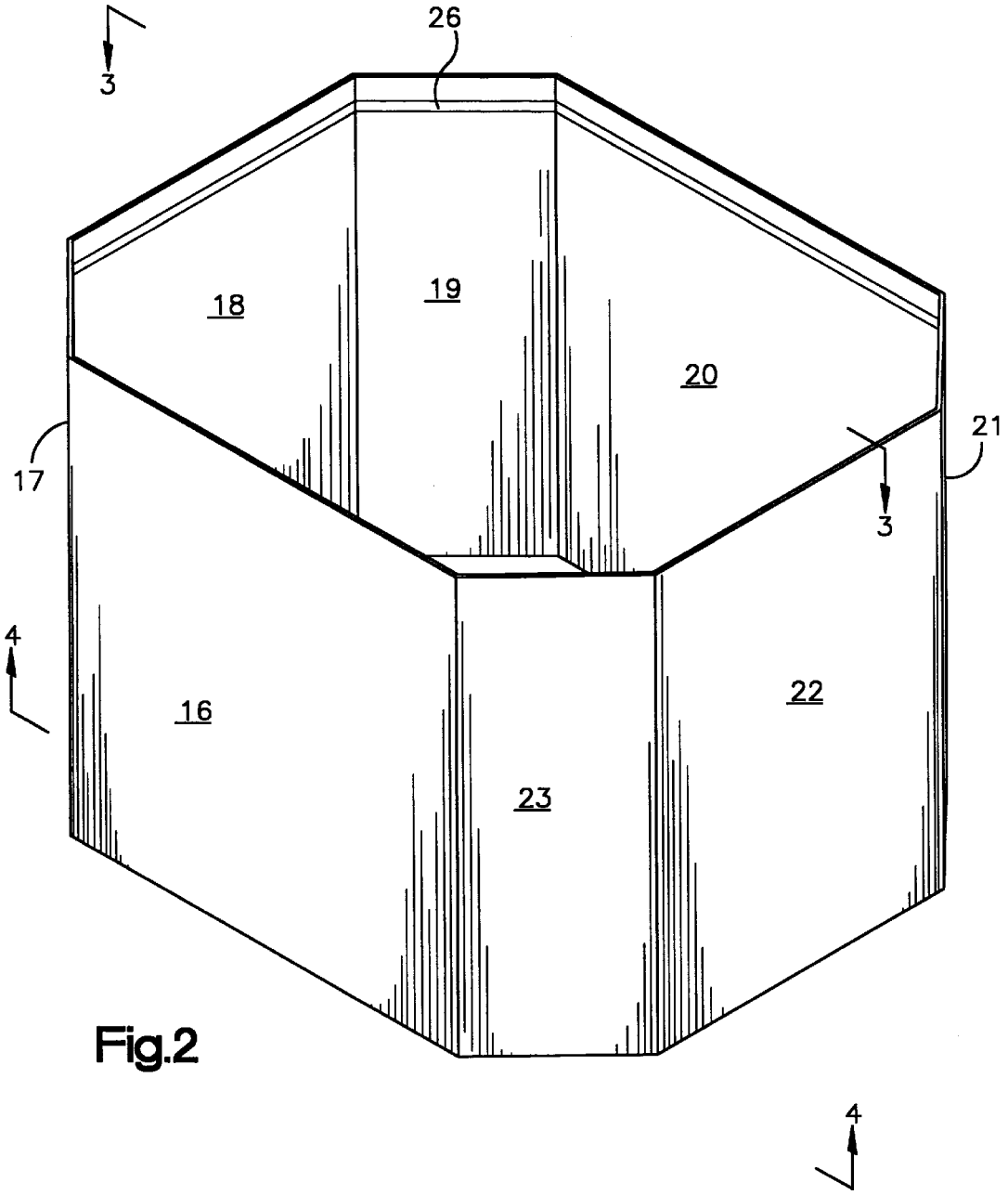
FIG. 2 is a perspective view of the preferred container employing the principals of the present invention.
Figure 3:
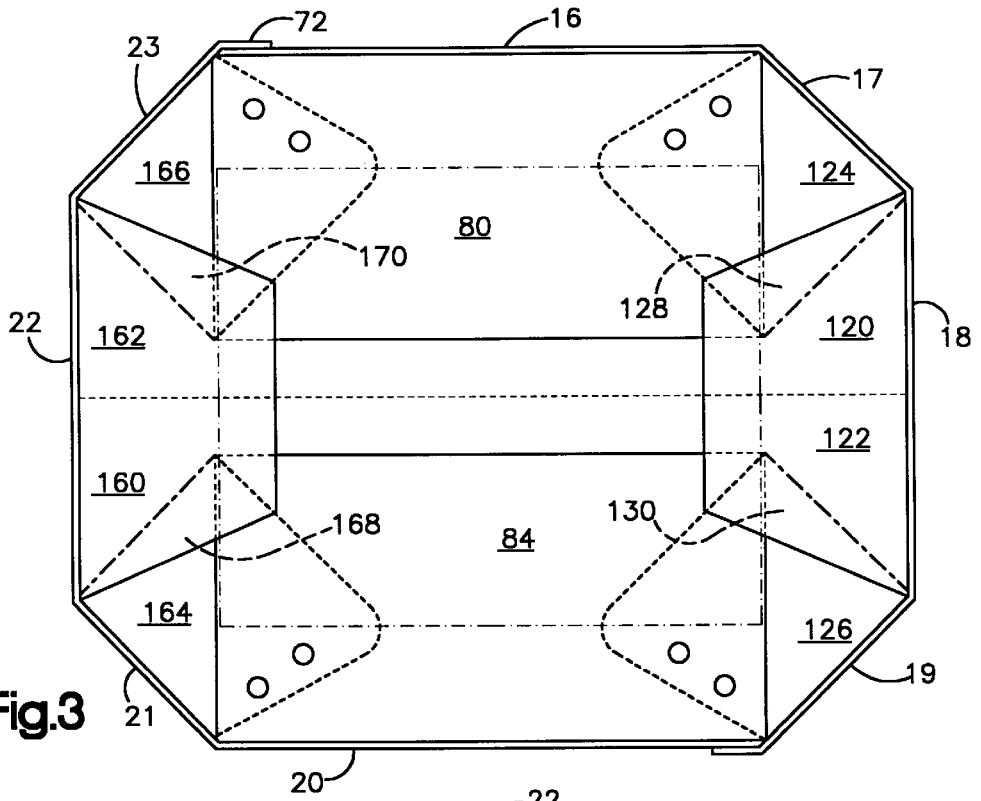
FIG. 3 is an enlarged horizontal sectional view taken along line 3—3 of FIG. 2 and looking downwardly at the bottom structure of the container of the present invention when in its fully-expanded condition.

Referring first to FIGS. 1–3, a planar blank 10 is illustrated as having a main body 12 and a connecting member 14. Both the main body 12 and the connecting member 14 are die-cut, preferably from double-faced corrugated paper although other suitable feedstock may be used such as cardboard, chipboard, single- or-double-faced corrugated paper, or the like. In addition, it is possible to construct the connecting member 14 from a material different from that forming the main body 12 such as to form a fiber board/paper combination respectively. In some applications of the preferred automatically-operating bottom structure, a plastic or hinged metallic connecting member may be used to provide additional reinforcement, rigidity and container integrity.

The main body 12 consists of eight vertically-elongated rectangular panels, individually indicated at 16–23, which are arranged side-by-side so as to be connected in series with one another. In the illustrated container, all of the rectangular panels 16–23 terminate at a common horizontal line top edge 24. A narrow glue strip 26 is disposed in series along each of the rectangular panels 16–23. The glue strip 26 runs substantially in parallel with the top edge 24.

Overall, left panel 16 is bounded by left vertical edge 32, right vertical fold line 34, and a lower horizontal fold line 36; panel 17 is bounded by left and right vertical fold lines 34, 38 and by a lower horizontal fold line 40; panel 18 is bounded by left and right vertical fold lines 38, 42 and by a lower horizontal fold line 44; panel 19 is bounded by left and right vertical fold lines 42, 46 and by a lower horizontal fold line 48; panel 20 is bounded by left and right vertical fold lines 46, 50 and by a lower horizontal fold line 52; panel 21 is bounded by left and right vertical fold lines 50, 54 and by a lower horizontal fold line 56; panel 22 is bounded by left and right vertical fold lines 54, 58 and by a lower horizontal fold line 60; and, panel 23 is bounded by left and right vertical fold lines 58, 62 and by a lower horizontal fold line 64.

An intermediate vertical score line 66 is provided in panel 18 for reasons which will be described below. Similarly, an intermediate vertical score line 68 is provided in panel 22. In general, however, each of the panels 18, 22 assume a planar configuration when the collapsible container A is in an opened condition. The score lines 66, 68 bisect panels 18, 22 respectively and enable the panels to be folded in half when the container is in folder-flat and intermediate conditions.

Each of the eight panels 16–30 are of substantially uniform height. Accordingly, left edge 32, right edge 70, and intermediate vertical score lines 34, 38, 42, 46, 50, 54, 58, 62, 66 and 68 are substantially parallel to one another, and are of substantially the same longitudinal extent. The upper edge 24 is formed in parallel with the lower fold lines 36, 40, 44, 48, 52, 56, 60 and 64 which are each represented as lying head-to-tail along a common horizontal line. The relative proportions of the various panels and fold lines depicted in the various drawing figures are, of course, dependent upon the particular thickness of the feedstock from which the blank 10 is formed. As an example, it may be necessary to offset the fold lines slightly from the adjacent edges and apart from other adjacent fold lines to permit for material flexure when using thick feedstock.

Figure 4:
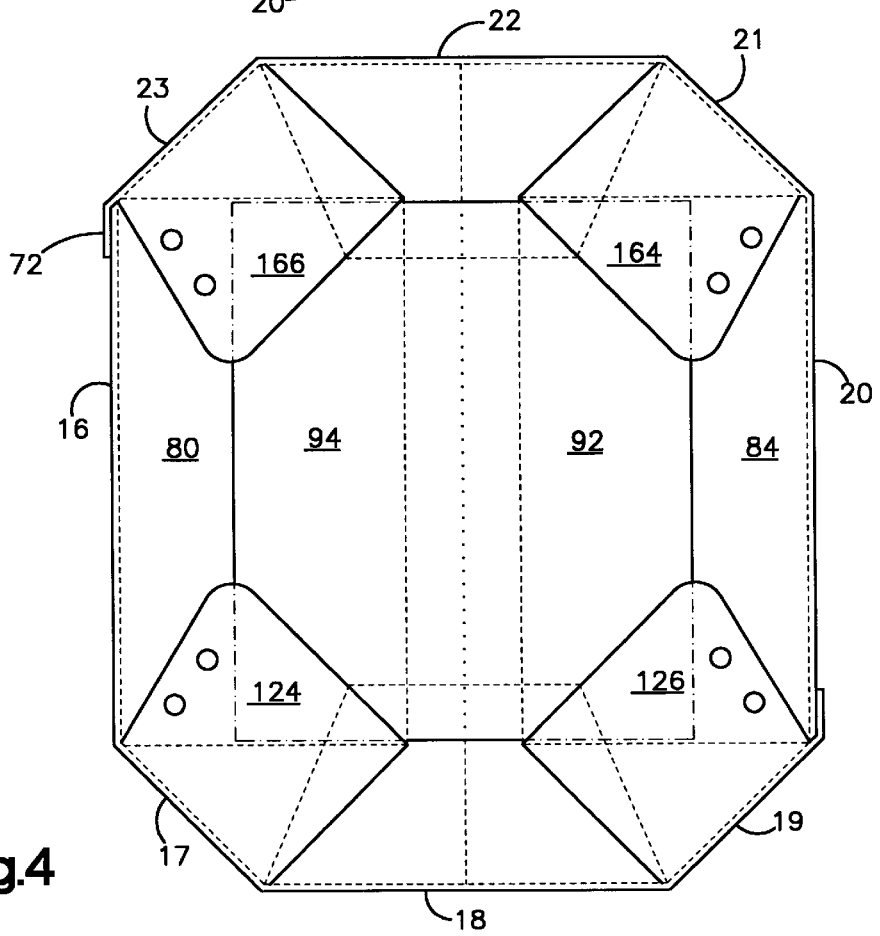
FIG. 4 is a bottom plan view of the preferred automatically-operating bottom structure in its fully-expanded condition taken generally along line 4—4 of FIG. 2.

A vertically-elongated narrow glue tab 72 extends rightwardly from the right-most panel 23. The glue tab 72 is bounded by left fold line 62, right vertical edge 70, top edge 24, and by an extension of the lower fold line 64 of the right panel 23. A suitable adhesive is applied to the obverse surface of the glue tab 72. Hence, when the adjacent panels are bent upwardly out of the plane of the paper through angles of about 45° relative to their next-adjacent panels, the glue tab 72 will overlap the left-most marginal end portion of the outwardly-facing surface of left panel 16 when the container is assembled as shown in FIGS. 2–5. Ideally, each of the adjacent panels 16–23 should be bent or folded about the fold lines so as to be inclined with respect to its intermediately-adjacent neighboring panels by obtuse included angles of about 135°, thereby to form a regular octagon which is best illustrated in FIGS. 3 and 4.

Having thus described the preferred eight-sided collapsible container B, attention will now be directed to the automatically-operating bottom structure A according to the present invention. Broadly, the improved bottom structure A includes a first band flap 80 extending downwardly from fold line 36, a first bottom flap 82 extending downwardly from fold lines 40, 44 and 48, a second band flap 84 extending downwardly from fold line 52 and a second bottom flap 86 extending downwardly from fold lines 56, 60 and 64.

The connecting member 14 of the bottom structure A includes a fold line 90 that essentially divides the member in half. A suitable adhesive is applied to the obverse surface of the connecting member 14 on a top portion 92 and on a bottom portion 94. The adhesive coated top and bottom portions 92, 94 are spaced apart by a narrow band 96 which includes the fold line 90. When the adjacent panels 16–23 are severally bent upwardly out of the plane of the paper through angles of about 45° to make an included angle of 135° relative to their next-adjacent panels, the top portion 92 is brought into overlapping contact with a bottom edge portion 100 of the second band flap 84 and bonded thereto. Similarly, in this position, the bottom portion 94 of the connecting member 14 is bonded to a bottom edge portion 102 of the first band flap 80. The connecting member 14 assumes a planar confirmation when the collapsible container is in a fully-expanded condition and assumes a folded-over confirmation when the collapsible container is in a folded-flat condition. Although the connecting member 14 is illustrated as being substantially rectangular, any suitable shape or size connecting member may be used provided that the first and second band flaps 80, 84 are connected.

The first band flap 80 is preferably shaped substantially as shown and is joined to panel 16 via score line 36, and having a left vertical edge 110, a lower horizontal edge 112, a right pointed edge 114, and a right inclined planar edge 116. The first band flap 80 is adapted to be folded through an angle of about 90° out of the paper relative to the panel section 16 when the container is in a fully-expanded condition. In the folded-flat condition, the first band flap 80 is oriented to form an included angle of about 0° with respect to the first panel 16. That is, the first band flap 80 is folded into the plane of the paper and disposed in face-to-face registration against the panel 16 when the container is in said folded-flat condition. A plurality of spaced apart holes 118 are provided in the first band flap for permitting free air flow through the bottom structure as the container is operated.

The first bottom flap 82 is specially configured so as to define a first pair of central bottom flaps 120, 122, a first pair of outer bottom flaps 124, 126 and a pair of web panels 128, 130. In the preferred bottom structure illustrated, all of the portions of the bottom flap 82 terminate at a common horizontal line bottom edge 132.

The left-most outer bottom flap 124 is defined by a left inclined planar edge 134, the lower horizontal edge 132, a right vertical score line 136 and the bottom fold line 40 of panel 17. The left-most web panel 128 is shaped substantially as a right triangle where the included angle β is preferably about 22.5°. The left-most web panel 128 is bounded by score line 136, the lower horizontal edge 132 and by a right inclined score line 138. The first pair of central bottom flaps 120, 122 are defined by the inclined score line 138, the lower horizontal edge 132, a right included score line 140 and by the lower horizontal fold line 44 of panel 18. The first pair of central bottom flaps 120, 122 are preferably bisected by a central score line 142 which extends from the lower end of panel 18 to the lower horizontal edge of the bottom flap 82. When the container is in the fully-expanded condition, the first pair of central bottom flaps 120, 122 assume a planar configuration with respect to each other. That is, the central bottom flaps 120, 122 lie in the same plane and form an included angle of essentially 180° about score line 142. However, when the container is in the folded-flat condition, the central bottom flaps 120, 122 are in face-to-face engagement to form an included angle of about 0° by being folded over score line 142. Further, in the folded-flat condition, the central bottom flaps 120, 122 engage the panel 18 by pivoting about lower horizontal fold line 44 of panel 18 such that the fold line 142 seats into a pocket formed by the fold line 66 bisecting panel 18. In the folded flat condition, the left-most outer bottom flap 124, the left-most web panel 128, and the left-most central bottom flap 120 lie in a common single plane and engage panels 17 and 18 by forming an included angle of essentially 0° about fold lines 40 and 44.

The right-most bottom flap 126 is defined by a right inclined planar edge 144, the lower horizontal edge 132, a left vertical score line 146 and the bottom fold line 48 of panel 19. The right-most web panel 130 is substantially shaped as a right triangle where the included angle β is preferably about 22.5°. The right-most web panel 130 is bounded by the inclined score line 140, the lower horizontal edge 132, and the score line 146. In the folded flat condition, the right-most outer bottom flap 126, the right-most web panel 130 and the right-most central bottom flap 122 lie in a common single plane and engage panels 18 and 19 by forming an included angle of substantially 0° about fold lines 44 and 48. In the fully-expanded condition, the right-most web panel 130 forms an included angle of substantially 0° with respect to both the right-most central bottom flap 122 and the right-most outer bottom flap 126 but on alternate sides of the right-most web panel 130. Essentially, in the fully-expanded condition, the flaps and panels 122, 130 and 126 form a "Z" configuration.

The second band flap 84 is preferably shaped substantially as shown and is joined to panel 20 via score line 52, and having a left inclined planar edge 150, a lower horizontal edge 152, and a right inclined planar edge 154. The second band flap 84 is adapted to be folded through an angle of about 90° out of the paper relative to the panel section 20 when the container is in a fully-expanded condition. In the folded-flat condition, the second band flap 84 is oriented to form an included angle of about 0° with respect to the panel 20. That is, the second band flap 84 is folded into the plane of the paper and disposed in face-to-face registration against the panel 20 when the container is in said folded-flat condition. A plurality of spaced apart holes 156 are provided in the second band flap 84 for permitting free air flow through the bottom structure as the container is operated.

The second bottom flap 86 is especially configured so as to define a second pair of central bottom flaps 160, 162, a second pair of outer bottom flaps 164, 166, and a pair of web panels 168, 170. In the preferred bottom structure, all of the portions of the second bottom flap 86 terminate at a common horizontal bottom edge 172.

The left-most outer bottom flap 164 is defined by a left inclined planar edge 174, the lower horizontal edge 172, a right vertical score line 176 and the bottom fold line 56 of panel 21. The left-most web panel 168 is shaped substantially as a right triangle where the included angle β is preferably about 22.5°. The left-most web panel 168 is bounded by score line 176, the lower horizontal edge 172 and by a right inclined score line 178. The second pair of central bottom flaps 160, 162 are defined by the inclined score line 178, the lower horizontal edge 172, a right inclined score line 180 and by the lower horizontal fold line 60 of panel 22. The second pair of central bottom flaps 160, 162 are preferably bisected by a central score line 182 which extends from the lower end of panel 22 to the lower horizontal edge of the bottom flap 86. When the container is in the fully-expanded condition, the second pair of central bottom flaps 160, 162 assume a planar configuration with respect to each other. That is, the bottom flaps 160, 162 lie in the same plane to form an included angle of substantially 180° about score line 182. When the container is in the folded-flat condition, the bottom flaps 160, 162 are in face-to-face engagement to form an included angle of substantially 0° about score line 182. Further, in the folded-flat condition, the flaps 160, 162 engage the panel 22 by pivoting about fold line 60 such that the fold line 182 seats into a pocket formed by the fold line 68 bisecting panel 22. In the folded flat condition, the left-most outer bottom flap 164, the left-most web panel 168, and the left-most central bottom flap 160 lie in a common single plane and engage panels 21 and 22 by forming an included angle of substantially 0° about fold lines 56 and 60.

The right-most outer bottom flap 166 is defined by a left vertical score line 184, the lower horizontal edge 172, a right inclined vertical score line 186, and the bottom fold line 64 of panel 23. The right-most web panel 170 is shaped substantially as a right triangle where the included angle β is preferably about 22.5°. The right-most web panel 170 is bounded by inclined vertical score line 180, the lower horizontal edge 172, and by the right vertical score line 184. In the folded flat condition, the right-most outer bottom flap 166, the right-most web panel 170, and the right-most central bottom flap 162 lie in a common single plane and engage panels 22 and 23 by forming an included angle of substantially 0° about fold lines 60 and 64.

Figure 5:
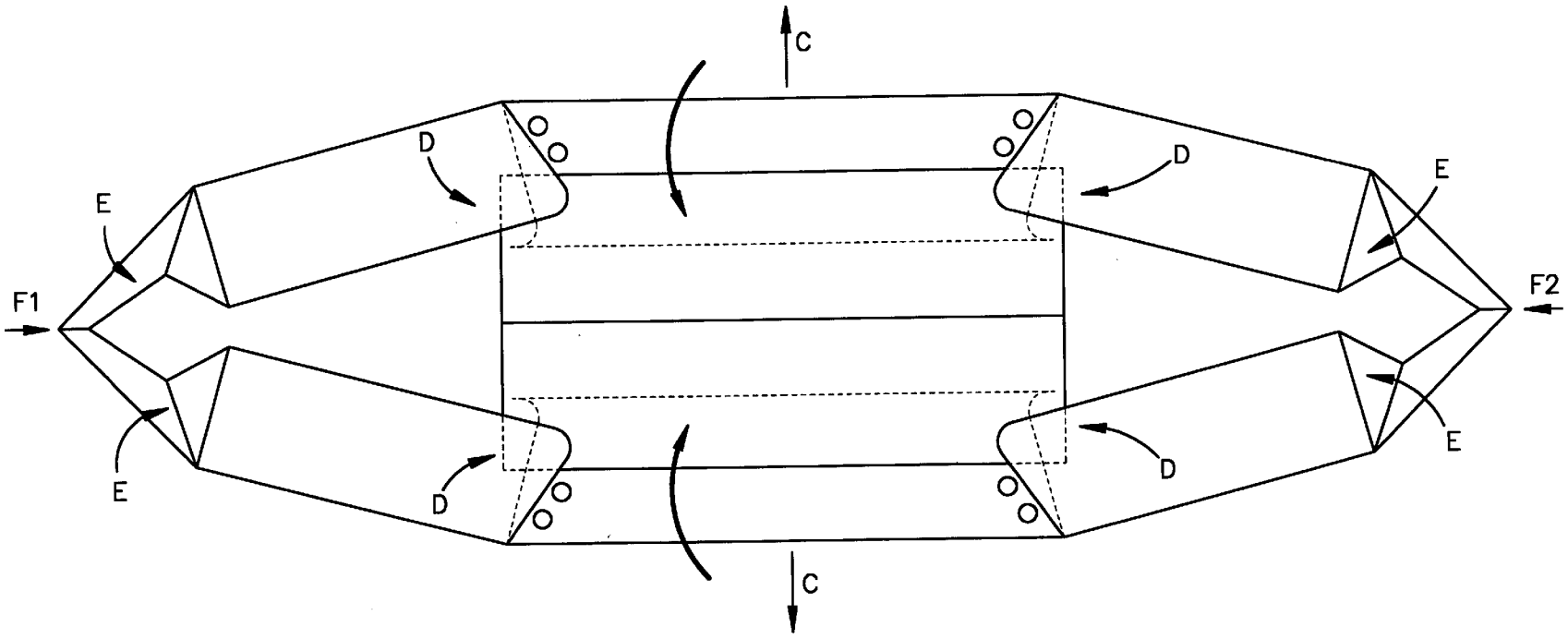
FIG. 5 is a top perspective view of the bottom structure according to the present invention when the container is in a midway condition between a fully collapsed position and a fully opened position shown in FIG. 2.

Turning now to the operation of the automatically-operating bottom structure reference will be made to FIG. 5. In an alternative embodiment of the present invention where a plastic liner is included glued along strip 62 of the container in combination with the automatically-operating bottom structure, the liner "unfurls" due to the motion of the panel portions comprising the bottom structure. In FIG. 5, the collapsible container and improved automatically-operating bottom structure are illustrated in an intermediate position between the folded-flat and fully-expanded conditions. The application of a pair of opposing forces F1, F2 at fold lines 66 and 68 respectively causes the collapsible container to expand. More particularly, the forces F1, F2 urge the panels 18 and 22 into relative motion toward one another respectively. This in turn causes the panels 16 and 20 to separate in a direction marked C. As the panels 16 and 20 separate, the first and second band flaps 80, 82 pivot from a 0° included angle to a 90° include angle with respect to their corresponding panels 16 and 20 respectively. The connecting member 14 pivots about fold line 90 as the panels 16, 20 separate and draw down into the page first and second band flaps 80 and 84 respectively.

Corresponding to the above-defined motion of the first and second band flaps 80, 84, the first and second pair of outer bottom flaps 124, 126 and 164, 166 move from a position of contact with their corresponding panel sections 17, 19 and 20, 23 respectively until an included angle of about 90° is formed therebetween. The first and second pairs of outer bottom flaps 124, 126 and 164, 166 move in a curvilinear direction with respect to the plane of the paper in a direction labeled D.

As the first and second pairs of outer bottom flaps 124, 126 and 164, 166 move, the first and second pairs of central bottom flaps 120, 122 and 160, 162 are drawn into the page as web illustrated via connection to the first and second pairs of web panels 128, 130 and 168, 170 respectively. The first and second pairs of central bottom flaps 120, 122 and 160, 162 move between contact with their corresponding panels 18 and 22 to an included angle of about 90° with respect to those panels in the fully-expanded condition. The first and second pairs of central bottom flaps 120, 122 and 160, 162 move in the direction labeled E in the drawings. As can be seen from the figure, the first and second band flaps 80, 84 as well as the connecting member 14 are captured between the outer flaps 124, 126, 164, 166 and the central flaps 120, 122, 160, 162 when the collapsible container is in the fully-expanded condition.

In the fully-expanded condition, the automatically-operating bottom structure A defines a plurality of panel portion planes which are stacked one upon another in a parallel arrangement. Generally, the central bottom flaps 120, 122 and 160, 162 engage the first and second band flaps 80, 84 respectively. The band flaps 80, 84 prevent pivotal motion of the central bottom flaps 120, 122 and 160, 162 beyond 90° with respect to their corresponding panels 18 and 22 respectively. In this condition, the first and second pair of web panels 128,130 and 168,170 are tucked under the first and second central bottom flap pairs 120, 122 and 160, 162 respectively as best illustrated in FIGS. 3 and 4. The first and second pairs of outer bottom flaps 124, 126 and 164, 166 are disposed beneath the connecting member 14 from the perspective of the bottom of the fully-expanded container as best illustrated in FIG. 4.

FIGS. 6–9 show a second embodiment of an improved automatically-operating bottom structure A for use with collapsible containers. Preferably, the invention is best used with a eight-sided collapsible container B and will be described with particular reference thereto. In an alternative embodiment, the invention includes the above-mentioned automatically-operating bottom structure in combination with a plastic liner affixed to the interior panel surfaces of an octagonal container. The liner unfurls as the automatically-operating bottom structure A is operated between a folded-flat condition and a fully-expanded condition.

Figure 6:
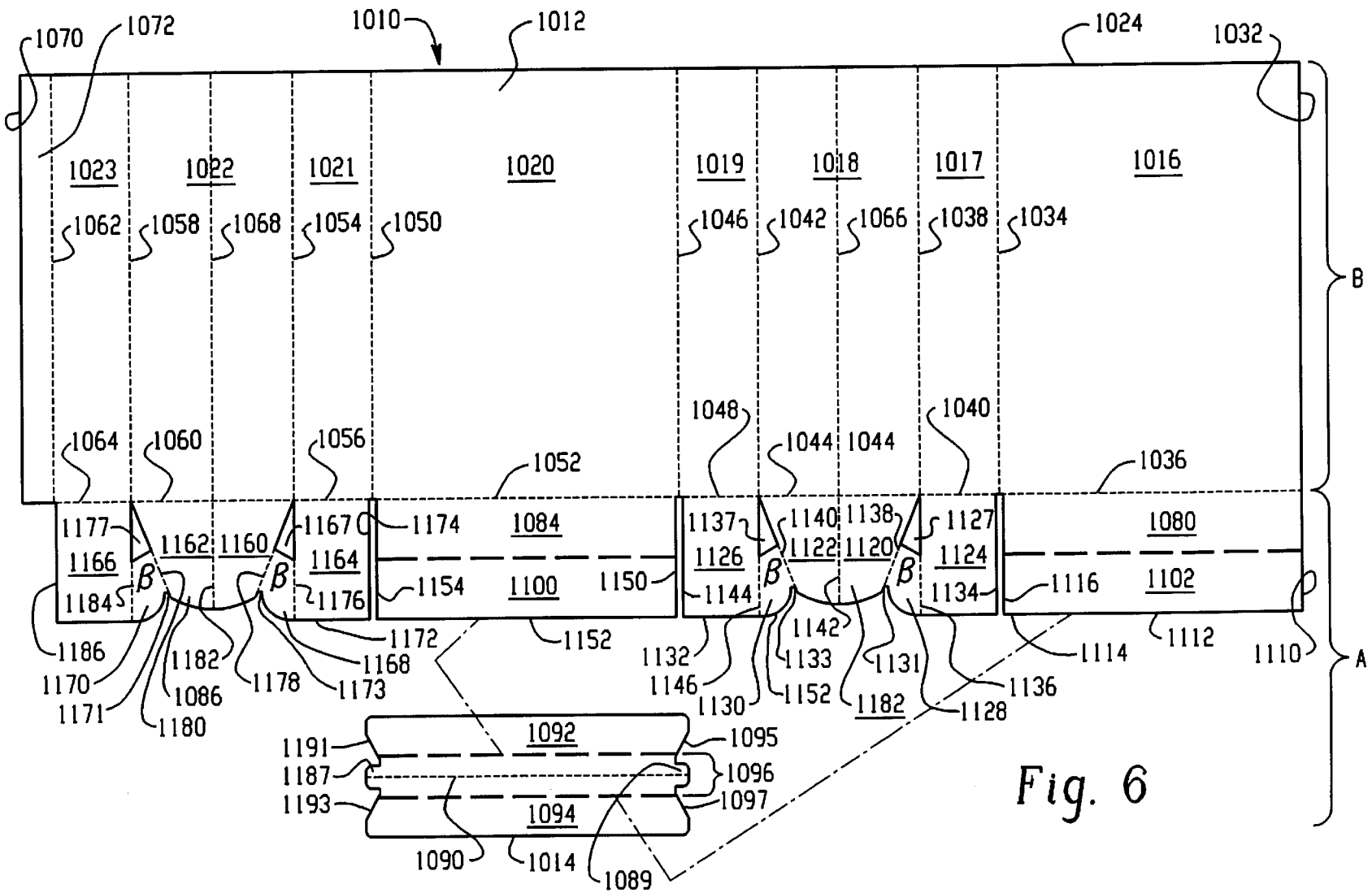
FIG. 6 is a plan view illustrating the preferred two-piece blank from which the self-opening collapsible container according to a second embodiment of the present invention is constructed.
Figure 8:
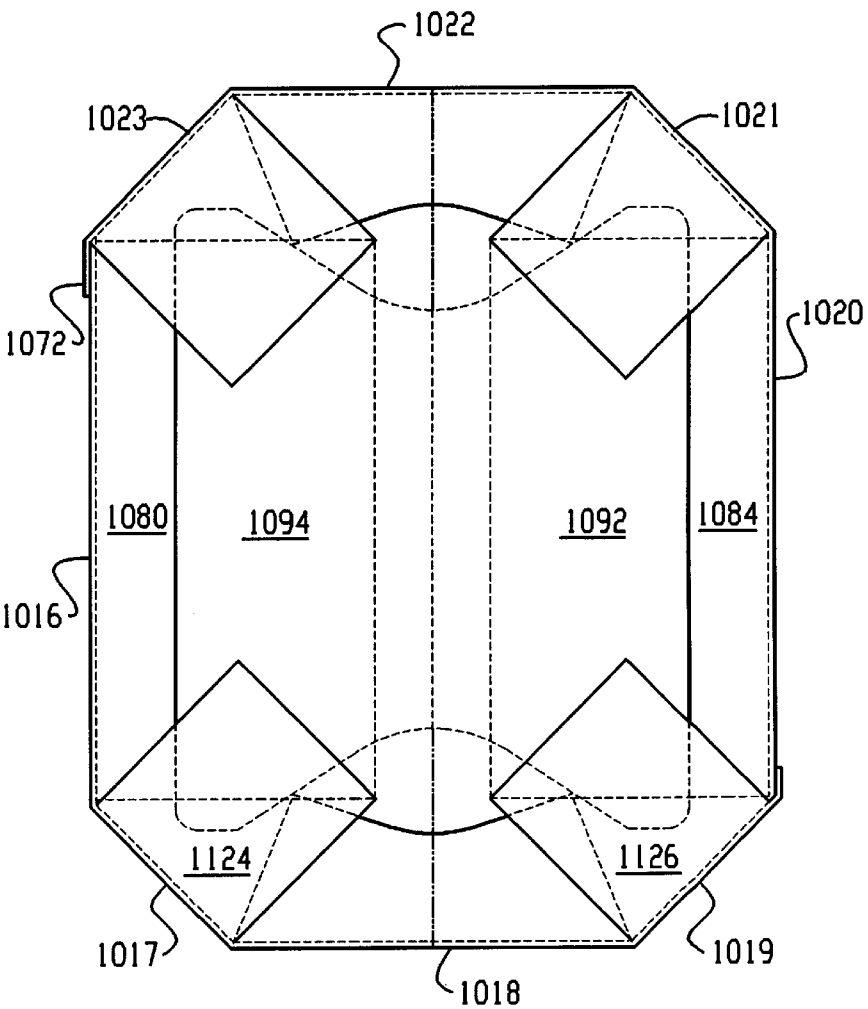
FIG. 8 is a bottom plan view of the container shown in FIG. 6, looking upwardly at the bottom structure of the container when in its fully-expanded condition.
Figure 7:
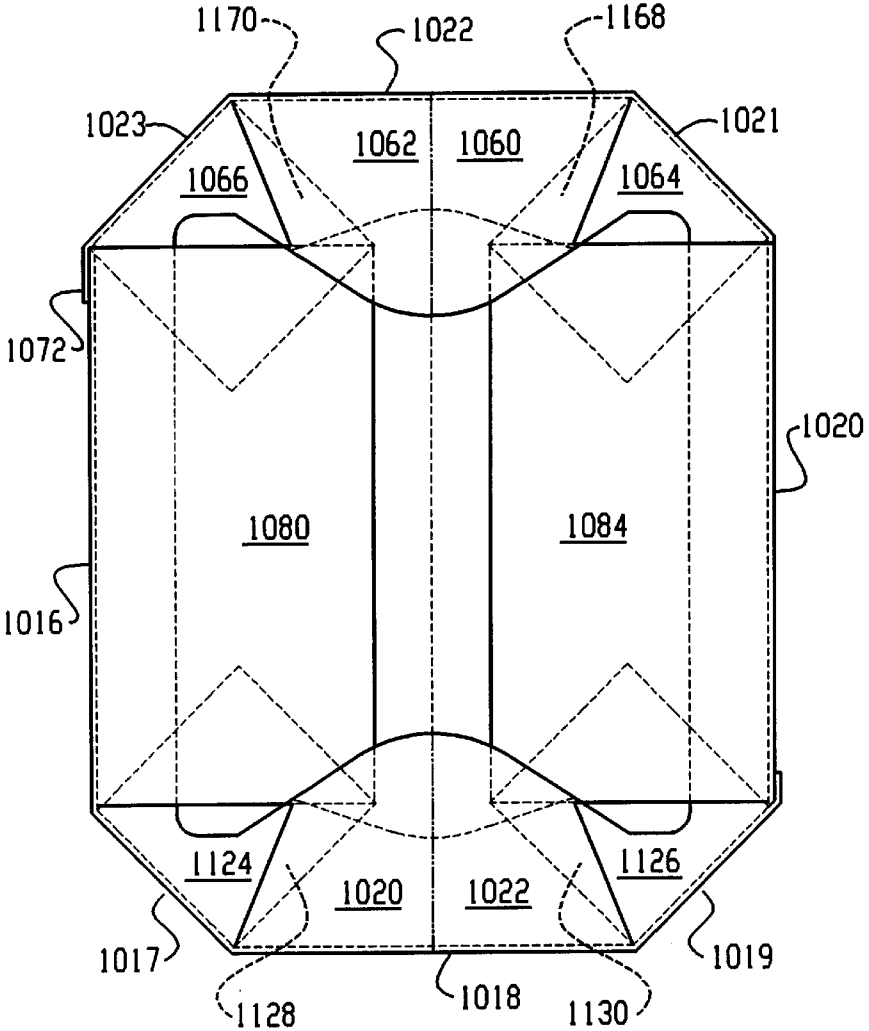
FIG. 7 is a top plan view of the container shown in FIG. 6, looking downwardly at the bottom structure of the container when in its fully-expanded condition.

Referring to FIGS. 6–8, a planar blank 1010 is illustrated as having a main body 1012 and a connecting member 1014. Both the main body 1012 and the connecting member 1014 are die-cut, preferably from double-faced corrugated paper although other suitable feedstock may be used such as cardboard, chipboard, single- or-double-faced corrugated paper, or the like. In addition, it is possible to construct the connecting member 1014 from a material different from that forming the main body 1012 such as to form a fiber board/paper combination respectively. In some applications of the preferred automatically-operating bottom structure, a plastic or hinged metallic connecting member may be used to provide additional reinforcement, rigidity and container integrity.

The main body 1012 consists of eight vertically-elongated rectangular panels, individually indicated at 1016–1023, which are arranged side-by-side so as to be connected in series with one another. In the illustrated container, all of the rectangular panels 1016–1023 terminate at a common horizontal line top edge 1024.

Overall, right panel 1016 is bounded by right vertical edge 1032, left vertical fold line 1034, and a lower horizontal fold line 1036; panel 1017 is bounded by right and left vertical fold lines 1034, 1038 and by a lower horizontal fold line 1040; panel 1018 is bounded by right and left vertical fold lines 1038, 1042 and by a lower horizontal fold line 1044; panel 1019 is bounded by right and left vertical fold lines 1042, 1046 and by a lower horizontal fold line 1048; panel 1020 is bounded by right and left vertical fold lines 1046, 1050 and by a lower horizontal fold line 1052; panel 1021 is bounded by right and left vertical fold lines 1050, 1054 and by a lower horizontal fold line 1056; panel 1022 is bounded by right and left vertical fold lines 1054, 1058 and by a lower horizontal fold line 1060; and, panel 1023 is bounded by right and left vertical fold lines 1058, 1062 and by a lower horizontal fold line 1064.

An intermediate vertical score line 1066 is provided in panel 1018 for reasons which will be described below. Similarly, an intermediate vertical score line 1068 is provided in panel 1022. In general, however, each of the panels 1018, 1022 assume a planar configuration when the collapsible container A is in an opened condition. The score lines 1066, 1068 bisect panels 1018, 1022 respectively and enable the panels to be folded in half when the container is in folder-flat and intermediate conditions.

Each of the eight panels 1016–1030 are of substantially uniform height. Accordingly, right edge 1032, left edge 1070, and intermediate vertical score lines 1034, 1038, 1042, 1046, 1050, 1054, 1058, 1062, 1066 and 1068 are substantially parallel to one another, and are of substantially the same longitudinal extent. The upper edge 1024 is formed in parallel with the lower fold lines 1036, 1040, 1044, 1048, 1052, 1056, 1060 and 1064 which are each represented as lying head-to-tail along a common horizontal line. The relative proportions of the various panels and fold lines depicted in the various drawing figures are, of course, dependent upon the particular thickness of the feedstock from which the blank 1010 is formed. As an example, it may be necessary to offset the fold lines slightly from the adjacent edges and apart from other adjacent fold lines to permit for material flexure when using thick feedstock.

A vertically-elongated narrow glue tab 1072 extends rightwardly from the left-most panel 1023. The glue tab 1072 is bounded by right fold line 1062, left vertical edge 1070, top edge 1024, and by an extension of the lower fold line 1064 of the left panel 1023. A suitable adhesive is applied to the obverse surface of the glue tab 1072. Hence, when the adjacent panels are bent upwardly out of the plane of the paper through angles of about 45° relative to their next-adjacent panels, the glue tab 1072 will overlap the left-most marginal end portion of the outwardly-facing surface of right panel 1016 when the container is assembled. It should be appreciated that when the container according to the second embodiment of the present invention is assembled, it will resemble the container shown in FIG. 2. Ideally, each of the adjacent panels 1016–1023 should be bent or folded about the fold lines so as to be inclined with respect to its intermediately-adjacent neighboring panels by obtuse included angles of about 135°, thereby to form a regular octagon which is best illustrated in FIGS. 7 and 8.

Having thus described the preferred eight-sided collapsible container B, attention will now be directed to the automatically-operating bottom structure A according to a second embodiment of the present invention. Broadly, bottom structure A includes a first band flap 1080 extending downwardly from fold line 1036, a first bottom flap 1082 extending downwardly from fold lines 1040, 1044 and 1048, a second band flap 1084 extending downwardly from fold line 1052 and a second bottom flap 1086 extending downwardly from fold lines 1056, 1060 and 1064.

The connecting member 1014 of the bottom structure A includes a fold line 1090 that essentially divides the member in half. A suitable adhesive is applied to the obverse surface of the connecting member 1014 on a top portion 1092 and on a bottom portion 1094. The adhesive coated top and bottom portions 1092, 1094 are spaced apart by a narrow band 1096 which includes the fold line 1090. When the adjacent panels 1016 through 1023 are severally bent upwardly out of the plane of the paper through angles of about 45° to make an included angle of 135° relative to their next-adjacent panels, the top portion 1092 is brought into overlapping contact with a bottom edge portion 1100 of the second band flap 1084 and bonded thereto. Similarly, in this position, the bottom portion 1094 of the connecting member 1014 is bonded to a bottom edge portion 1102 of the first band flap 1080. The connecting member 1014 assumes a planar confirmation when the collapsible container is in a fully-expanded condition and assumes a folded-over confirmation when the collapsible container is in a folded-flat condition. Connecting member 1014 also includes left edge slots 1091 and 1093, which are formed along the left side edge of connecting member 1014, and right edge slots 1095 and 1097, which are formed along the right side edge of connecting member 1014. Left edge slots 1091, 1093 define a left tongue 1087, while right edge slots 1095, 1097 define a right tongue 1089. The purpose of edge slots 1091, 1093, 1095 and 1097 and tongues 1087 and 1089 will be described below.

The first band flap 1080 is preferably shaped substantially as shown and is joined to panel 1016 via score line 1036, and having a right vertical edge 1110, a lower horizontal edge 1112, a left edge 1114, and a left vertical edge 1116. The first band flap 1080 is adapted to be folded through an angle of about 90° out of the paper relative to the panel section 1016 when the container is in a fully-expanded condition. In the folded-flat condition, the first band flap 1080 is oriented to form an included angle of about 0° with respect to the first panel 1016. That is, the first band flap 1080 is folded into the plane of the paper and disposed in face-to-face registration against the panel 1016 when the container is in said folded-flat condition.

The first bottom flap 1082 is specially configured so as to define a first pair of central bottom flaps 1120, 1122, a first pair of outer bottom flaps 1124, 1126 and a pair of web panels 1128, 1130. In the preferred bottom structure illustrated, all of the portions of the bottom flap 1082 terminate at a lower horizontal edge 1132. Lower horizontal edge 1132 includes slots 1131 and 1133. Slot 1131 is defined by bottom flap 1120 and web panel 1128. Slot 1133 is defined by bottom flap 1122 and web panel 1130. The purpose of slots 1131 and 1133 will be described below.

The right-most outer bottom flap 1124 is defined by a right vertical edge 1134, the lower horizontal edge 1132, a left vertical score line 1136 and the bottom fold line 1040 of panel 1017. The right-most web panel 1128 is shaped substantially as a right triangle where the included angle $\beta$ is preferably about 22.5°. The right-most web panel 1128 is bounded by score line 1136, the lower horizontal edge 1132 and by an inclined score line 1138. A triangular opening 1127 is formed inside web panel 1128 to facilitate rotation of web panel 1128 during the expanding and collapsing of the container. The first pair of central bottom flaps 1120, 1122 are defined by the inclined score line 1138, the lower horizontal edge 1132, an inclined score line 1140 and by the lower horizontal fold line 1044 of panel 1018. The first pair of central bottom flaps 1120, 1122 are preferably bisected by a central score line 1142 which extends from the lower end of panel 1018 to the lower horizontal edge of the bottom flap 1082. When the container is in the fully-expanded condition, the first pair of central bottom flaps 1120, 1122 assume a planar configuration with respect to each other. That is, the central bottom flaps 1120, 1122 lie in the same plane and form an included angle of essentially 180° about score line 1142. However, when the container is in the folded-flat condition, the central bottom flaps 1120, 1122 are in face-to-face engagement to form an included angle of about 0° by being folded over score line 1142. Further, in the folded-flat condition, the central bottom flaps 1120, 1122 engage the panel 1018 by pivoting about lower horizontal fold line 1044 of panel 1018 such that the fold line 1142 seats into a pocket formed by the fold line 1066 bisecting panel 1018. In the folded flat condition, the right-most outer bottom flap 1124, the right-most web panel 1128, and the right-most central bottom flap 1120 lie in a common single plane and engage panels 1017 and 1018 by forming an included angle of essentially 0° about fold lines 1040 and 1044.

The left-most bottom flap 1126 is defined by a left vertical edge 1144, the lower horizontal edge 1132, a right vertical score line 1146 and the bottom fold line 1048 of panel 1019. The left-most web panel 1130 is substantially shaped as a right triangle where the included angle β is preferably about 22.5°. The left-most web panel 1130 is bounded by the inclined score line 1140, the lower horizontal edge 1132, and the score line 1146. A triangular opening 1137 is formed inside web panel 1130 to facilitate rotation of web panel 1130 during the expanding and collapsing of the container. In the folded flat condition, the left-most outer bottom flap 1126, the left-most web panel 1130 and the left-most central bottom flap 1122 lie in a common single plane and engage panels 1018 and 1019 by forming an included angle of substantially 0° about fold lines 1044 and 1048. In the fully-expanded condition, the left-most web panel 1130 forms an included angle of substantially 0° with respect to both the left-most central bottom flap 1122 and the left-most outer bottom flap 1126 but on alternate sides of the left-most web panel 1130. Essentially, in the fully-expanded condition, the flaps and panels 1122, 1130 and 1126 form a "Z" configuration.

The second band flap 1084 is preferably shaped substantially as shown and is joined to panel 1020 via score line 1052, and having a right vertical edge 1150, a lower horizontal edge 1152, and a left vertical edge 1154. The second band flap 1084 is adapted to be folded through an angle of about 90° out of the paper relative to the panel section 1020 when the container is in a fully-expanded condition. In the folded-flat condition, the second band flap 1084 is oriented to form an included angle of about 0° with respect to the panel 1020. That is, the second band flap 1084 is folded into the plane of the paper and disposed in face-to-face registration against the panel 1020 when the container is in said folded-flat condition.

The second bottom flap 1086 is especially configured so as to define a second pair of central bottom flaps 1160, 1162, a second pair of outer bottom flaps 1164, 1166, and a pair of web panels 1168, 1170. In the preferred bottom structure, all of the portions of the second bottom flap 1086 terminate at a lower horizontal edge 1172. Lower horizontal edge 1172 includes slots 1171 and 1173. Slot 1171 is defined by bottom flap 1162 and web panel 1170, while slot 1173 is defined by bottom flap 1160 and web panel 1168. The purpose of slots 1171 and 1173 will be described below.

The right-most outer bottom flap 1164 is defined by a right vertical edge 1174, the lower horizontal edge 1172, a left vertical score line 1176 and the bottom fold line 1056 of panel 1021. The right-most web panel 1168 is shaped substantially as a right triangle where the included angle β is preferably about 22.5°. The right-most web panel 1168 is bounded by score line 1176, the lower horizontal edge 1172 and by a right inclined score line 1178. A triangular opening 1167 is formed inside web panel 1168 to facilitate rotation of web panel 1168 during the expanding and collapsing of the container. The second pair of central bottom flaps 1160, 1162 are defined by the inclined score line 1178, the lower horizontal edge 1172, a left inclined score line 1180 and by the lower horizontal fold line 1060 of panel 1022. The second pair of central bottom flaps 1160, 1162 are preferably bisected by a central score line 1182 which extends from the lower end of panel 1022 to the lower horizontal edge of the bottom flap 1086. When the container is in the fully-expanded condition, the second pair of central bottom flaps 1160, 1162 assume a planar configuration with respect to each other. That is, the bottom flaps 1160, 1162 lie in the same plane to form an included angle of substantially 180° about score line 1182. When the container is in the folded-flat condition, the bottom flaps 1160, 1162 are in face-to-face engagement to form an included angle of substantially 0° about score line 1182. Further, in the folded-flat condition, the flaps 1160, 1162 engage the panel 1022 by pivoting about fold line 1060 such that the fold line 1182 seats into a pocket formed by the fold line 1068 bisecting panel 1022. In the folded flat condition, the right-most outer bottom flap 1164, the right-most web panel 1168, and the right-most central bottom flap 1160 lie in a common single plane and engage panels 1021 and 1022 by forming an included angle of substantially 0° about fold lines 1056 and 1060.

The left-most outer bottom flap 1166 is defined by a right vertical score line 1184, the lower horizontal edge 1172, a left vertical edge 1186, and the bottom fold line 1064 of panel 1023. The left-most web panel 1170 is shaped substantially as a right triangle where the included angle β is preferably about 22.5°. The left-most web panel 1170 is bounded by inclined vertical score line 1180, the lower horizontal edge 1172, and by the right vertical score line 1184. A triangular opening 1177 is formed inside web panel 1170 to facilitate rotation of web panel 1170 during the expanding and collapsing of the container. In the folded flat condition, the right-most outer bottom flap 1166, the left-most web panel 1170, and the left-most central bottom flap 1162 lie in a common single plane and engage panels 1022 and 1023 by forming an included angle of substantially 0° about fold lines 1060 and 1064.

Figure 9:
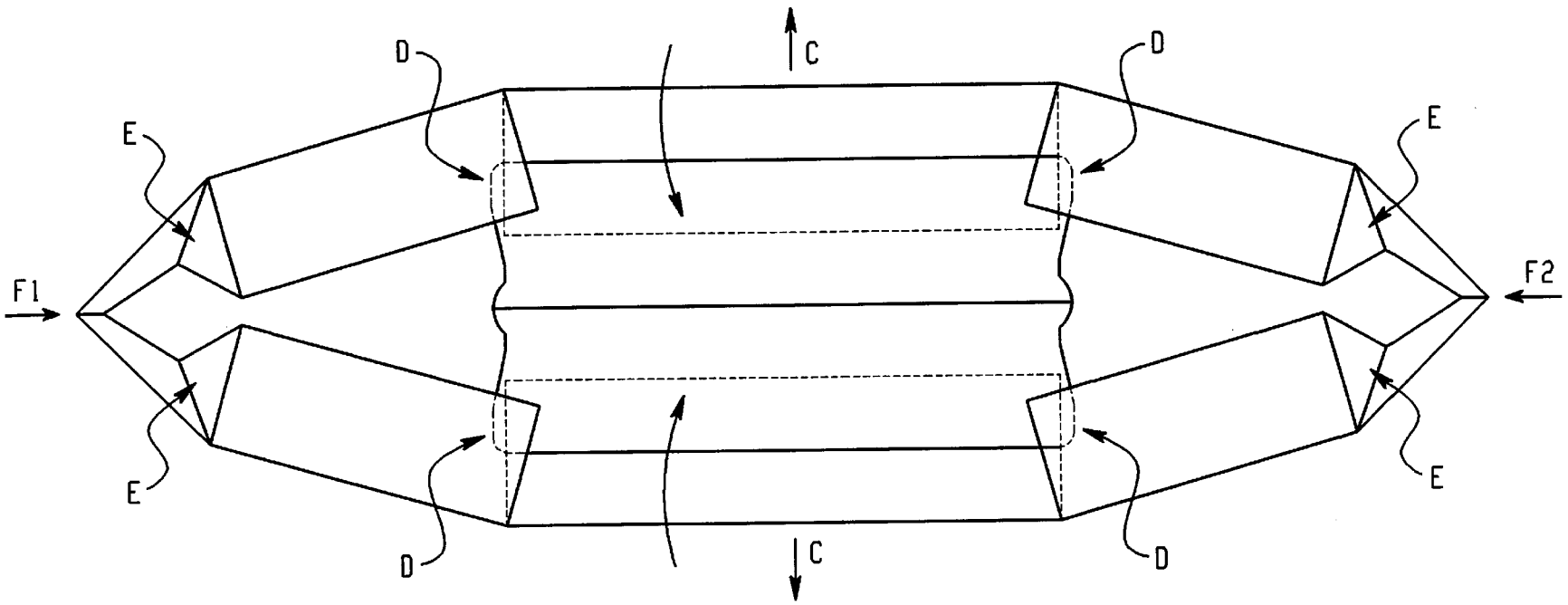
FIG. 9 is a top perspective view of the bottom structure according to the second embodiment of the present invention, when the container is in a midway condition between a fully collapsed position and a fully opened position.

Turning now to the operation of the automatically-operating bottom structure reference will be made to FIG. 9. In an alternative embodiment of the present invention where a plastic liner is included glued along strip 1062 of the container in combination with the automatically-operating bottom structure, the liner "unfurls" due to the motion of the panel portions comprising the bottom structure. In FIG. 9, the collapsible container and improved automatically-operating bottom structure are illustrated in an intermediate position between the folded-flat and fully-expanded conditions. The application of a pair of opposing forces F1, F2 at fold lines 1066 and 1068 respectively causes the collapsible container to expand. More particularly, the forces F1, F2 urge the panels 1018 and 1022 into relative motion toward one another respectively. This in turn causes the panels 1016 and 1020 to separate in a direction marked C. As the panels 1016 and 1020 separate, the first and second band flaps 1080, 1082 pivot from a 0° included angle to a 90° include angle with respect to their corresponding panels 1016 and 1020 respectively. The connecting member 1014 pivots about fold line 1090 as the panels 1016, 1020 separate and draw down into the page first and second band flaps 1080 and 1084 respectively.

Corresponding to the above-defined motion of the first and second band flaps 1080, 1084, the first and second pair of outer bottom flaps 1124, 1126 and 1164, 1166 move from a position of contact with their corresponding panel sections 1017, 1019 and 1020, 1023 respectively until an included angle of about 90° is formed therebetween. The first and second pairs of outer bottom flaps 1124, 1126 and 1164, 1166 move in a curvilinear direction with respect to the plane of the paper in a direction labeled D.

As the first and second pairs of outer bottom flaps 1124, 1126 and 1164, 1166 move, the first and second pairs of central bottom flaps 1120, 1122 and 1160, 1162 are drawn into the page as web illustrated via connection to the first and second pairs of web panels 1128, 1130 and 1168, 1170 respectively. The first and second pairs of central bottom flaps 1120, 1122 and 1160, 1162 move between contact with their corresponding panels 1018 and 1022 to an included angle of about 90° with respect to those panels in the fully-expanded condition. The first and second pairs of central bottom flaps 1120, 1122 and 1160, 1162 move in the direction labeled E in the drawings. As can be seen from FIGS. 7 and 8, the first and second band flaps 1080, 1084 as well as the connecting member 1014 are captured between the outer flaps 1124, 1126, 1164, 1166 and the central flaps 1120, 1122, 1160, 1162 when the collapsible container is in the fully-expanded condition.

In the fully-expanded condition, the automatically-operating bottom structure A defines a plurality of panel portion planes which are stacked one upon another in a parallel arrangement. Generally, the central bottom flaps 1120, 1122 and 1160, 1162 engage the first and second band flaps 1080, 1084 respectively. The band flaps 1080, 1084 prevent pivotal motion of the central bottom flaps 1120, 1122 and 1160, 1162 beyond 90° with respect to their corresponding panels 1018 and 1022 respectively. In this condition, the first and second pair of web panels 1128, 1130 and 1168, 1170 are tucked under the first and second central bottom flap pairs 1120, 1122 and 1160, 1162 respectively as best illustrated in FIGS. 7 and 8. The first and second pairs of outer bottom flaps 1124, 1126 and 1164, 1166 are disposed beneath the connecting member 1014 from the perspective of the bottom of the fully-expanded container as best illustrated in FIG. 8.

Furthermore, in the fully-expanded position, right edge slot 1095 interlocks with slot 1133, while right edge slot 1097 interlocks with slot 1131. In this way, right tongue 1089 overlaps first pair of central bottom flaps 1120, 1222. Similarly, left edge slot 1091 interlocks with slot 1173, while left edge slot 1093 interlocks with slot 1171. As a result, left tongue 1087 overlaps second pair of central bottom flaps 1160, 1162. The interlocking of the slots provides for a generally flat inner bottom surface for the container. Consequently, materials stored in the container cannot become trapped beneath first pair of central bottom flaps 1120, 1122 and second pair of central bottom flaps 1160, 1162 inside the container.

FIGS. 10–13 show a third embodiment of an improved automatically-operating bottom structure A for use with collapsible containers. Preferably, the invention is best used with a eight-sided collapsible container B and will be described with particular reference thereto. In an alternative embodiment, the invention includes the above-mentioned automatically-operating bottom structure in combination with a plastic liner affixed to the interior panel surfaces of an octagonal container. The liner unfurls as the automatically-operating bottom structure A is operated between a folded-flat condition and a fully-expanded condition.

Figure 10:
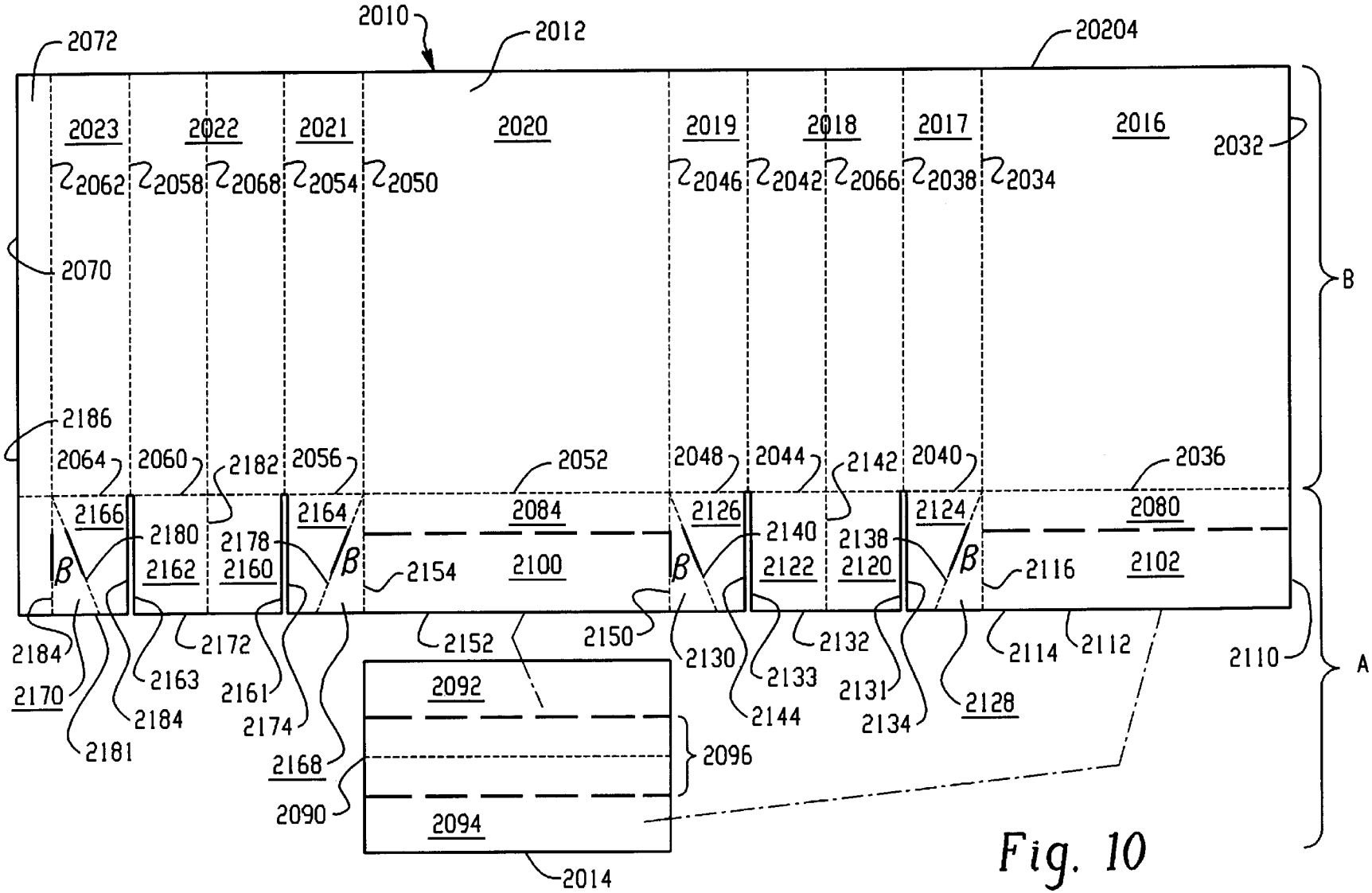
FIG. 10 is a plan view illustrating the preferred two-piece blank from which the self-opening collapsible container according to a third embodiment of the present invention is constructed.

Referring to FIG. 10, a planar blank 2010 is illustrated as having a main body 2012 and a connecting member 2014. Both the main body 2012 and the connecting member 2014 are die-cut, preferably from double-faced corrugated paper although other suitable feedstock may be used such as cardboard, chipboard, single- or-double-faced corrugated paper, or the like. In addition, it is possible to construct the connecting member 2014 from a material different from that forming the main body 2012 such as to form a fiber board/paper combination respectively. In some applications of the preferred automatically-operating bottom structure, a plastic or hinged metallic connecting member may be used to provide additional reinforcement, rigidity and container integrity.

The main body 2012 consists of eight vertically-elongated rectangular panels, individually indicated at 2016–2023, which are arranged side-by-side so as to be connected in series with one another. In the illustrated container, all of the rectangular panels 2016–2023 terminate at a common horizontal line top edge 2024.

Overall, right panel 2016 is bounded by right vertical edge 2032, left vertical fold line 2034, and a lower horizontal fold line 2036; panel 2017 is bounded by right and left vertical fold lines 2034, 2038 and by a lower horizontal fold line 2040; panel 2018 is bounded by right and left vertical fold lines 2038, 2042 and by a lower horizontal fold line 2044; panel 2019 is bounded by right and left vertical fold lines 2042, 2046 and by a lower horizontal fold line 2048; panel 2020 is bounded by right and left vertical fold lines 2046, 2050 and by a lower horizontal fold line 2052; panel 2021 is bounded by right and left vertical fold lines 2050, 2054 and by a lower horizontal fold line 2056; panel 2022 is bounded by right and left vertical fold lines 2054, 2058 and by a lower horizontal fold line 2060; and panel 2023 is bounded by right and left vertical fold lines 2058, 2062 and by a lower horizontal fold line 2064.

An intermediate vertical score line 2066 is provided in panel 2018 for reasons which will be described below. Similarly, an intermediate vertical score line 2068 is provided in panel 2022. In general, however, each of the panels 2018, 2022 assume a planar configuration when the collapsible container A is in an opened condition. The score lines 2066, 2068 bisect panels 2018, 2022 respectively and enable the panels to be folded in half when the container is in folder-flat and intermediate conditions.

Each of the eight panels 2016–2030 are of substantially uniform height. Accordingly, right edge 2032, left edge 2070, and intermediate vertical score lines 2034, 2038, 2042, 2046, 2050, 2054, 2058, 2062, 2066 and 2068 are substantially parallel to one another, and are of substantially the same longitudinal extent. The upper edge 2024 is formed in parallel with the lower fold lines 2036, 2040, 2044, 2048, 2052, 2056, 2060 and 2064 which are each represented as lying head-to-tail along a common horizontal line. The relative proportions of the various panels and fold lines depicted in the various drawing figures are, of course, dependent upon the particular thickness of the feedstock from which the blank 2010 is formed. As an example, it may be necessary to offset the fold lines slightly from the adjacent edges and apart from other adjacent fold lines to permit for material flexure when using thick feedstock.

Figure 12:
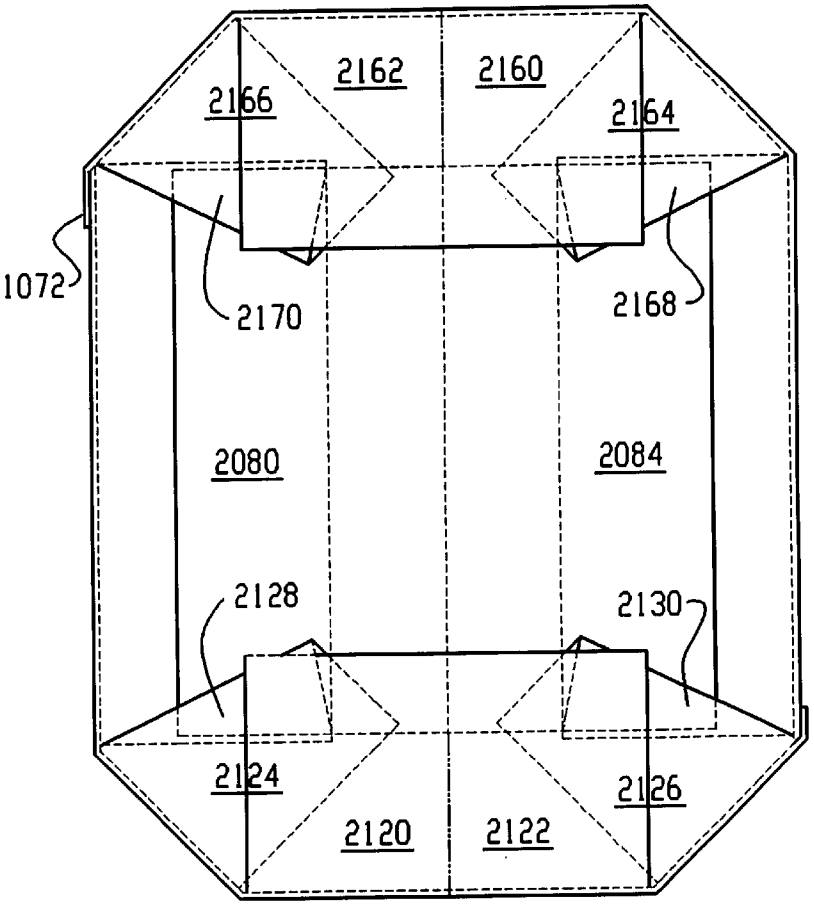
FIG. 12 is a bottom plan view of the container shown in FIG. 10, looking upwardly at the bottom structure of the container when in its fully-expanded condition.
Figure 11:
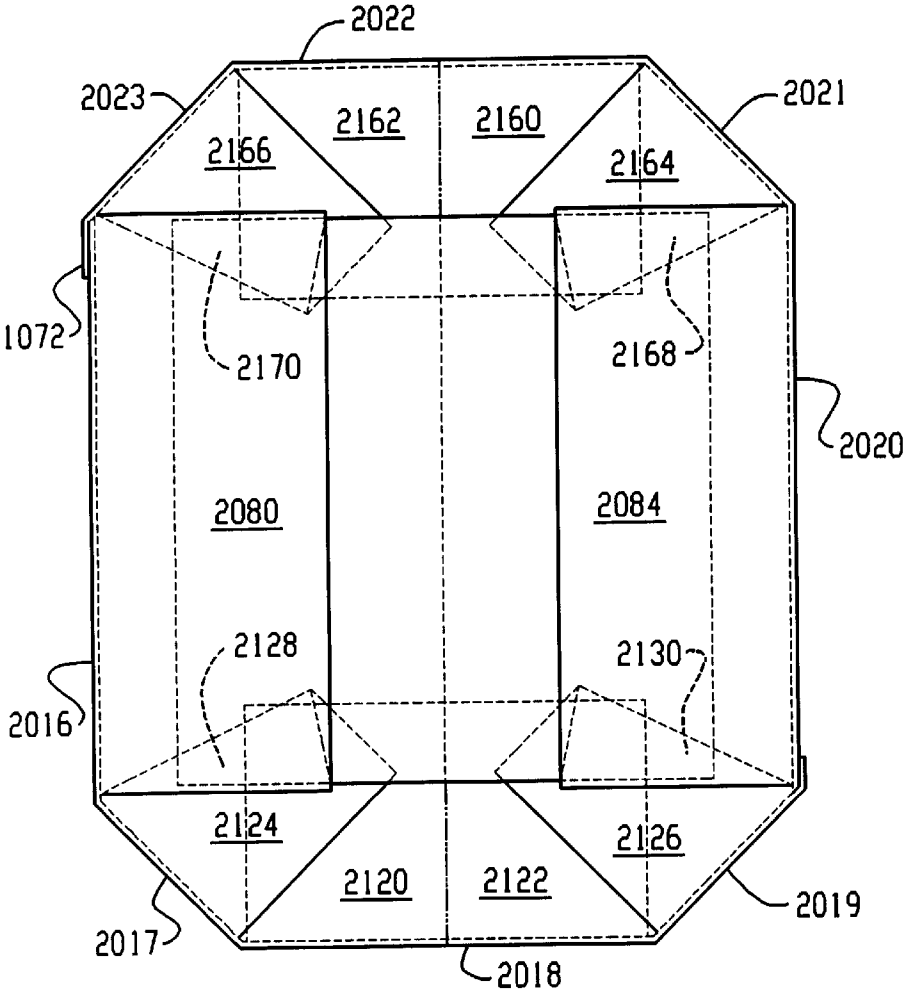
FIG. 11 is a top plan view of the container shown in FIG. 10, looking downwardly at the bottom structure of the container when in its fully-expanded condition.

A vertically-elongated narrow glue tab 2072 extends rightwardly from the left-most panel 2023. The glue tab 2072 is bounded by right fold line 2062, left vertical edge 2070, top edge 2024, and by an extension of the lower fold line 2064 of the left panel 2023. A suitable adhesive is applied to the obverse surface of the glue tab 2072. Hence, when the adjacent panels are bent upwardly out of the plane of the paper through angles of about 45° relative to their next-adjacent panels, the glue tab 2072 will overlap the left-most marginal end portion of the outwardly-facing surface of right panel 2016 when the container is assembled. It should be appreciated that when the container according to the third embodiment of the present invention is assembled, it will resemble the container shown in FIG. 2. Ideally, each of the adjacent panels 2016–2023 should be bent or folded about the fold lines so as to be inclined with respect to its intermediately-adjacent neighboring panels by obtuse included angles of about 135°, thereby to form a regular octagon which is best illustrated in FIGS. 11 and 12.

Having thus described the preferred eight-sided collapsible container B, attention will now be directed to the automatically-operating bottom structure A according to a third embodiment of the present invention. Broadly, bottom structure A includes a first band flap 2080 extending downwardly from fold line 2036, a first web panel 2128, a first bottom flap 2124 extending downwardly from fold line 2040, a first pair of central bottom flaps 2120, 2122 extending downwardly from fold line 2044, a second bottom flap 2126 extending downwardly from fold lines 2048, a second web panel 2130, a second band flap 2084 extending downwardly from fold line 2052, a third web panel 2168, a third bottom flap 2164 extending downwardly from fold line 2056, a second pair of central bottom flaps 2160, 2162 extending downwardly from fold line 2060, a fourth bottom flap 2166 extending downwardly from fold line 2064 and a fourth web panel 2170.

The connecting member 2014 of the bottom structure A includes a fold line 2090 that essentially divides the member in half. A suitable adhesive is applied to the obverse surface of the connecting member 2014 on a top portion 2092 and on a bottom portion 2094. The adhesive coated top and bottom portions 2092, 2094 are spaced apart by a narrow band 2096 which includes the fold line 2090. When the adjacent panels 2016 through 2023 are severally bent upwardly out of the plane of the paper through angles of about 45° to make an included angle of 135° relative to their next-adjacent panels, the top portion 2092 is brought into overlapping contact with a bottom edge portion 2100 of the second band flap 2084 and bonded thereto. Similarly, in this position, the bottom portion 2094 of the connecting member 2014 is bonded to a bottom edge portion 2102 of the first band flap 2080. The connecting member 2014 assumes a planar confirmation when the collapsible container is in a fully-expanded condition and assumes a folded-over confirmation when the collapsible container is in a folded-flat condition.

The first band flap 2080 is preferably shaped substantially as shown and is joined to panel 2016 via score line 2036, and having a right vertical edge 2110, a lower horizontal edge 2112, a left edge 2114, and a left vertical score line 2116. The first band flap 2080 is adapted to be folded through an angle of about 90° out of the paper relative to the panel section 2016 when the container is in a fully-expanded condition. In the folded-flat condition, the first band flap 2080 is oriented to form an included angle of about 180° with respect to the first panel 2016. The first band flap 2082 and first bottom flap 2124 are specially configured so as to define first web panel 2128.

The first bottom flap 2124 is defined by a left vertical edge 2134, the lower horizontal edge 2112, an inclined score line 2138 and the bottom fold line 2040 of panel 2017. The first web panel 2128 is shaped substantially as a right triangle where the included angle β is preferably about 22.5°. The first web panel 2128 is bounded by vertical score line 2116, the lower horizontal edge 2112 and by inclined score line 2138.

The first pair of central bottom flaps 2120, 2122 are defined by a right vertical edge 2131, the lower horizontal edge 2132, a left vertical edge 2133 and by the lower horizontal fold line 2044 of panel 2018. The first pair of central bottom flaps 2120, 2122 are preferably bisected by a central score line 2142. When the container is in the fully-expanded condition, the first pair of central bottom flaps 2120, 2122 assume a planar configuration with respect to each other. That is, the central bottom flaps 2120, 2122 lie in the same plane and form an included angle of essentially 180° about score line 2142. However, when the container is in the folded-flat condition, the central bottom flaps 2120, 2122 are in face-to-face engagement to form an included angle of about 0° by being folded over score line 2142.

The second band flap 2084 is preferably shaped substantially as shown and is joined to panel 2020 via score line 2052, and having a right vertical score line 2150, a lower horizontal edge 2152, and a left vertical score line 2154. The second band flap 2084 is adapted to be folded through an angle of about 90° out of the paper relative to the panel section 2020 when the container is in a fully-expanded condition. In the folded-flat condition, the second band flap 2084 is oriented to form an included angle of about 180° with respect to the first panel 2020. The second band flap 2084 and second bottom flap 2126 are specially configured so as to define the second web panel 2130. Similarly, the second band flap 2084 and third bottom flap 2164 are specially configured so as to define the third web panel 2168.

The second bottom flap 2126 is defined by a right vertical edge 2144, the lower horizontal edge 2152, an inclined score line 2140 and the bottom fold line 2048 of panel 2019. The second web panel 2130 is substantially shaped as a right triangle where the included angle β is preferably about 22.5°. The second web panel 2130 is bounded by the inclined score line 2140, the lower horizontal edge 2152, and the vertical score line 2150.

The third bottom flap 2164 is defined by a left vertical edge 2174, the lower horizontal edge 2152, an inclined score line 2178 and the bottom fold line 2056 of panel 2021. The third web panel 2168 is substantially shaped as a right triangle where the included angle β is preferably about 22.5°. The third web panel 2168 is bounded by the inclined score line 2178, the lower horizontal edge 2152, and the vertical score line 2154.

The second pair of central bottom flaps 2160, 2162 are defined a right vertical edge 2161, the lower horizontal edge 2172, a left vertical edge 2163 and by the lower horizontal fold line 2060 of panel 2022. The second pair of central bottom flaps 2160, 2162 are preferably bisected by a central score line 2182. When the container is in the fully-expanded condition, the second pair of central bottom flaps 2160, 2162 assume a planar configuration with respect to each other. That is, the central bottom flaps 2160, 2162 lie in the same plane and form an included angle of essentially 180° about score line 2182. However, when the container is in the folded-flat condition, the central bottom flaps 2160, 2162 are in face-to-face engagement to form an included angle of about 0° by being folded over score line 2182.

The fourth bottom flap 2166 is defined by a right vertical edge 2184, a lower horizontal edge 2181, an inclined score line 2180 and the bottom fold line 2064 of panel 2023. The fourth web panel 2170 is shaped substantially as a right triangle where the included angle β is preferably about 22.5°. The fourth web panel 2170 is bounded by left vertical score line 2184, the lower horizontal edge 2181 and by an inclined score line 2180.

In the folded flat condition, the first band flap 2080, the first web panel 2128, the first bottom flap 2124, the fourth web panel 2170 and the fourth bottom flap 2166 lie in a common single plane. Likewise, in the flat folded condition, the second band flap 2084, the second web panel 2130, the second bottom flap 2126, the third web panel 2168 and the third bottom flap 2164 lie in a common single plane.

In the fully-expanded condition, the first web panel 2128 and first bottom flap 2124 form an included angle of substantially 0° with respect to the first band flap 2080; and the fourth web panel 2170 and the fourth bottom flap 2166 form an included angle of substantially 0° with respect to the first band flap 2080. Likewise, the second web panel 2130 and second bottom flap 2126 form an included angle of substantially 0° with respect to the second band flap 2084; and the third web panel 2168 and the third bottom panel 2164 form an included angle of substantially 0° with respect to the second band flap 2084. Essentially, in the fully-expanded condition, the flaps and panels 2080, 2128 and 2124 form a "Z" configuration; the flaps and panels 2080, 2170 and 2166 form a "Z" configuration; the flaps and panels 2084, 2126 and 2130 form a "Z" configuration; and the flaps and panels 2084, 2168 and 2164 form a "Z" configuration.

Figure 13:
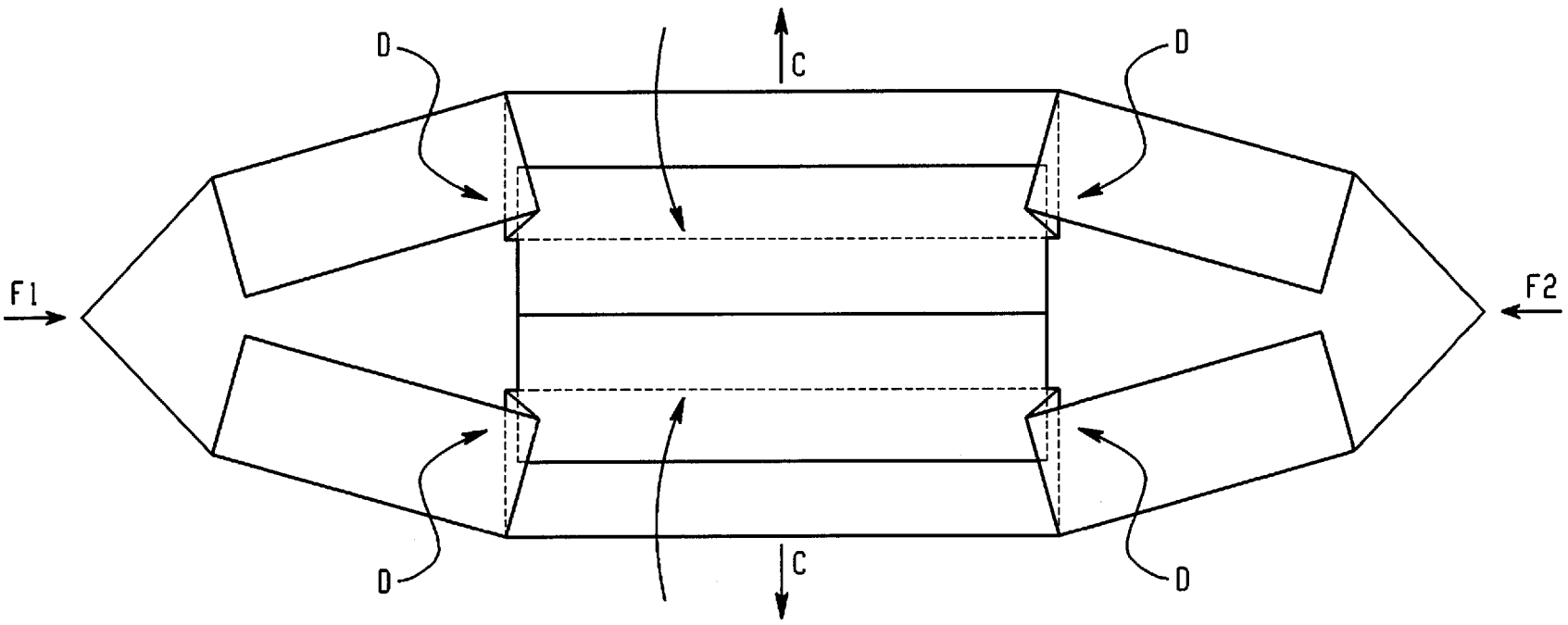
FIG. 13 is a top perspective view of the bottom structure according to the third embodiment of the present invention, when the container is in a midway condition between a fully collapsed position and a fully opened position.

Turning now to the operation of the automatically-operating bottom structure reference will be made to FIG. 13. In an alternative embodiment of the present invention where a plastic liner is included glued along strip 2062 of the container in combination with the automatically-operating bottom structure, the liner "unfurls" due to the motion of the panel portions comprising the bottom structure. In FIG. 13, the collapsible container and improved automatically-operating bottom structure are illustrated in an intermediate position between the folded-flat and fully-expanded conditions. The application of a pair of opposing forces F1, F2 at fold lines 2066 and 2068 respectively causes the collapsible container to expand. More particularly, the forces F1, F2 urge the panels 2018 and 2022 into relative motion toward one another respectively. This in turn causes the panels 2016 and 2020 to separate in a direction marked C. As the panels 2016 and 2020 separate, the first and second band flaps 2080, 2082 pivot from a 0° included angle to a 90° include angle with respect to their corresponding panels 2016 and 2020 respectively. The connecting member 2014 pivots about fold line 2090 as the panels 2016, 2020 separate and draw down into the page first and second band flaps 2080 and 2084 respectively.

Corresponding to the above-defined motion of the first and second band flaps 2080, 2084, the first, second, third and fourth bottom flaps 2124, 2126, 2164 and 2166 move from a generally co-planar position with their corresponding panel sections 2017, 2019 and 2020, 2023 respectively until an included angle of about 90° is formed therebetween. The first, second, third and fourth bottom flaps 2124, 2126, 2164 and 2166 move in a curvilinear direction with respect to the plane of the paper in a direction labeled D.

As the first, second, third and fourth bottom flaps 2124, 2126, 2164 and 2166 move, the first, second, third and fourth web panels 2128, 2130, 2168 and 2166 are drawn towards first and second band flaps 2080, 2084. The first and second pairs of central bottom flaps 2120, 2122 and 2160, 2162 are manually foldable between a co-planar position with their corresponding panels 2018 and 2022 to an included angle of about 90° with respect to those panels in the fully-expanded condition.

As can be seen from FIGS. 11 and 12, first, second, third and fourth bottom flaps 2124, 2126, 2164 and 2166, as well as the first, second, third and fourth web panels 2128, 2130, 2168 and 2170 are at least partially overlapped by first and second pairs of central bottom flaps 2120, 2122 and 2160, 2162 when the collapsible container is in the fully-expanded condition.

In the fully-expanded condition, the automatically-operating bottom structure A defines a plurality of panel portion planes which are stacked one upon another in a parallel arrangement. Generally, the first and fourth web panels 2128, 2170 engage the first band flap 2080, while the second and third web panels 2130, 2168 engage the second band flap 2084. In this condition, the first and second pair of web panels 2128, 2170 and 2130, 2168 are respectively tucked under the first and fourth bottom flaps 2124, 2166 and the second and third bottom flaps 2126, 2164, as best illustrated in FIGS. 11 and 12.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, I now claim:

1. A container adapted to be selectively moved between a folded condition and an expanded condition, comprising:

a plurality of panels being pivotally connected along adjacent longitudinal edges so as to be arranged in series with one another, the panels being arranged in generally opposing pairs when the container is in an expanded condition;

a band pivotally connected to each of a first pair of panels, the band having at least first and second sections disposed about an intermediate pivotal axis therebetween, which intermediate pivotal axis is generally-parallel to pivotal axes between the band and each of the first pair of panels, the first and second sections being disposed with one another and with their respective panels so as to be generally parallel to one another when the container is in a folded condition and generally co-planar to one another when the container is in the expanded condition;

a first pair of bottom flaps, each connected respectively to one panel of a second pair of the panels, each of the first pair of bottom flaps adapted to partially overlap a first surface of the band so as to be generally perpendicular to its associated panel and generally parallel with the band when the container is in the expanded condition;

a second pair of bottom flaps, each connected respectively to one panel of a third pair of the panels, each of the second pair of flaps adapted to partially overlap a selected surface of the band so as to be generally perpendicular to its associated panel and generally parallel with the band when the container is in the expanded condition;

a third pair of bottom flaps, each connected respectively to one panel of a fourth pair of the panels, each of the third pair of flaps adapted to be generally perpendicular to its associated panel when the container is in the expanded condition;

a first pair of web panels connecting a one of said first pair of bottom flaps with said second pair of bottom flaps; and a second pair of web panels connecting the other of said first pair of bottom flaps with said third pair of bottom flaps, wherein said first pair of web panels and one of said first pair of bottom flaps respectively define a first pair of slots, and said second pair of web panels and the other of said first pair of bottom flaps respectively define a second pair of slots, said first and second pair of slots receiving a portion of the band.

2. A collapsible container according to claim 1, wherein said band includes a third pair of slots and a fourth pairs of slots, said third and fourth pair of slots respectively interlocking with said first and second pair of slots when the container is fully expanded.

3. A collapsible container according to claim 1, wherein:

said first and second pair of web panels is generally parallel with said at least one bottom flap of a pair of bottom flaps when the container is fully expanded.

4. A collapsible container according to claim 3, wherein:

each of said at least one pair of web panels is generally co-planar with said at least one bottom flap of a pair of bottom flaps when the container is fully flat.

5. A collapsible container according to claim 4, wherein each of said second pair of said panels and its associated one of said first pair of bottom flaps are folded about a longitudinal axis substantially midway between the longitudinal edges of said panels, the respective halves of said second pair of panels being generally parallel when the container is in said folded-flat condition and being generally co-planar when the container is fully expanded.

6. A collapsible container according to claim 5, wherein said first and second pair of web panels partially overlaps said first surface of said band when the container is fully expanded.

7. A collapsible container according to claim 6, wherein said means for connecting said two sections of said band is a connecting member bonded to said two sections of said band and defining said intermediate pivotal axis.

8. A collapsible container adapted to be selectively moved between a folded-flat condition and a fully-expanded condition, said container having a plurality of panels being pivotally connected along adjacent longitudinal edges so as to be arranged in series with one another, said panels being arranged in opposing pairs when the container is in said fully-expanded condition, and an automatically-operating bottom structure comprising:

a band pivotally connected to each of a first pair of panels, the band having at least first and second sections, and means for connecting said first and second sections about an intermediate pivotal axis substantially parallel to pivotal axes between said band and said first pair of panels, said first and second sections being disposed with respect to one another so as to be generally parallel to one another when said container is in said folded-flat condition and being disposed with respect to one another so as to be generally co-planar when said container is in said fully-expanded condition;

a first pair of bottom flaps each connected respectively to one of a second pair of said panels, each of said first pair of bottom flaps adapted to be generally perpendicular to its associated panel when the container is in said fully-expanded condition;

a second pair of bottom flaps, each connected respectively to one panel of a third pair of said panels, each of said second pair of flaps adapted to be generally perpendicular to its associated panel when the container is in said fully-expanded condition;

a third pair of bottom flaps, each connected respectively to one panel of a fourth pair of said panels, each of said third pair of flaps adapted to be substantially perpendicular to its associated panel when the container is said fully-expanded condition; and at least one pair of web panels, each panel of a pair thereof being pivotally connected to at least one bottom flap of a pair of bottom flaps and being pivotally connected to the band.

9. A collapsible container according to claim 8, wherein each of said second pair of said panels and its associated one of said first pair of bottom flaps are folded about a longitudinal axis substantially midway between the longitudinal edges of said panels, the respective halves of said second pair of panels being generally parallel when the container is in said folded-flat condition and being generally co-planar when the container is fully expanded.

10. A collapsible container according to claim 8, wherein said means for connecting said two sections of said band is a connecting member bonded to said two sections of said band and defining said intermediate pivotal axis.

11. A collapsible container according to claim 8, wherein said first pair of bottom flaps are movable independent of said second pair of bottom flaps.

12. A collapsible container according to claim 8, wherein said first pair of bottom flaps are movable independent of said third pair of bottom flaps.

13. A collapsible container according to claim 8, wherein said first pair of bottom flaps are movable independent of said at least one pair of web panels.

14. An automatically-operating bottom structure for use with a collapsible container adapted to be selectively moved between a folded-flat condition and a fully-expanded condition, said container having a plurality of panels being pivotally connected along their adjacent longitudinal edges so as to be arranged in series with one another, said panels being arranged in opposing pairs when the container is in said fully-expanded condition, the automatically-operating bottom structure comprising:

a band pivotally connected to each of a first pair of said panels, the band having two sections pivotally connected to one another about an intermediate pivotal axis substantially parallel to the pivotal axes between said band and said first pair of panels, said two sections being arranged with respect to one another at an included angle of about 0° when said container is in said folded-flat condition and being arranged with respect to one another at an included angle of about 180° when said container is in said fully-expanded condition;

a first pair of bottom flaps each connected to a one of a second pair of said panels, each of said first pair of bottom flaps engaging a first surface of said band and forming an included angle of about 90° with respect to its associated panel when the container is in said fully-expanded condition;

a second pair of bottom flaps, each connected to a one of a third pair of said panels, each of said second pair of bottom flaps engaging a second surface opposite said first surface of said band and forming an included angle of about 90° with respect to its associated panel when the container is in said fully-expanded condition;

a third pair of bottom flaps, each connected to a one of a fourth pair of said panels, each of said third pair of bottom flaps engaging said second surface of said band and forming an included angle of about 90° with respect to its associated panel when the container is in said fully-expanded condition;

a first pair of web panels connecting a one of said first pair of bottom flaps with said second pair of bottom flaps; and a second pair of web panels connecting the other of said first pair of bottom flaps with said third pair of bottom flaps, wherein said first pair of web panels and a first of said first pair of bottom flaps respectively define a first pair of slots, and said second pair of web panels and a second of said first pair of bottom flaps respectively define a second pair of slots, said first and second pair of slots receiving a portion of the band.

15. The automatically-operating bottom structure according to claim 14 wherein:

each of said first pair included angle of about 0° with respect to said first one of said first pair of bottom flaps and said second pair of bottom flaps when the container is in said fully-expanded condition; and, each of said second pair of web panels form an included angle of about 0° between said second one of said first pair of bottom flaps and said third pair of bottom flaps when the container is in said fully-expanded condition.

16. The automatically-operating bottom structure according to claim 15 wherein:

each of said first pair of web panels form an included angle of about 180° with respect to said first one of said first pair of bottom flaps and said second pair of bottom flaps when the container is in said fully-flat condition; and, each of said second pair of web panels form an included angle of about 180° between said second one of said first pair of bottom flaps and said third pair of bottom flaps when the container is in said fully-flat condition.

17. The automatically-operating bottom structure according to claim 16 wherein each of said second pair of said panels and its associated one of said first pair of bottom flaps are folded about a longitudinal axis substantially midway between the longitudinal edges of said panel, the respective halves of said second pair of panels being arranged at an included angle of about 0° when the container is in said folded-flat condition and being arranged at an included angle of about 180° when the container is in said fully-expanded condition.

18. The automatically-operating bottom structure according to claim 17 wherein each of said first pair of web panels and said second pair of web panels engage said first surface of said band when the container is in said fully-expanded condition.

19. The automatically-operating bottom structure according to claim 18 further including a connecting member bonded to said two sections of said band and defining said intermediate pivotal axis.

* * * * *